US011015610B2

(12) United States Patent
Ishii et al.

(10) Patent No.: US 11,015,610 B2
(45) Date of Patent: May 25, 2021

(54) CENTRIFUGAL BLOWER

(71) Applicants: DENSO CORPORATION, Kariya (JP); SOKEN, INC., Nisshin (JP)

(72) Inventors: Fumiya Ishii, Kariya (JP); Shuzo Oda, Kariya (JP); Masanori Yasuda, Nisshin (JP)

(73) Assignees: DENSO CORPORATION, Kariya (JP); SOKEN, INC., Nisshin (JP)

( * ) Notice: Subject to any disclaimer, the term of this patent is extended or adjusted under 35 U.S.C. 154(b) by 196 days.

(21) Appl. No.: 16/320,472

(22) PCT Filed: Jun. 8, 2017

(86) PCT No.: PCT/JP2017/021390

§ 371 (c)(1),
(2) Date: Jan. 24, 2019

(87) PCT Pub. No.: WO2018/020854

PCT Pub. Date: Feb. 1, 2018

(65) Prior Publication Data

US 2019/0242396 A1 Aug. 8, 2019

(30) Foreign Application Priority Data

Jul. 27, 2016 (JP) ..... JP2016-147548
Mar. 17, 2017 (JP) ..... JP2017-053145

(51) Int. Cl.
*F04D 29/28* (2006.01)
*F04D 17/08* (2006.01)
(Continued)

(52) U.S. Cl.
CPC ..... *F04D 29/281* (2013.01); *F04D 17/08* (2013.01); *F04D 25/0613* (2013.01);
(Continued)

(58) Field of Classification Search
CPC .... F04D 29/281; F04D 25/0613; F04D 29/66; F04D 29/666; F04D 29/28
See application file for complete search history.

(56) References Cited

U.S. PATENT DOCUMENTS 3,221,398 A * 12/1965 Mayne ..... B21D 53/267 29/889.4
4,647,271 A * 3/1987 Nagai ..... F04D 29/281 416/186 R
(Continued)

FOREIGN PATENT DOCUMENTS

EP 0694697 A1 * 1/1996 ..... F04D 29/285
EP 2264320 A1 12/2010
(Continued)

OTHER PUBLICATIONS

English translation of EP0694697A1 (Year: 1996).*

*Primary Examiner* — David E Sosnowski
*Assistant Examiner* — Wesley Le Fisher
(74) *Attorney, Agent, or Firm* — Harness, Dickey & Pierce, P.L.C.

(57) ABSTRACT

A centrifugal blower includes an outer rotor, and a turbo fan. The turbo fan includes blades, an other end plate, and a cylinder portion. The cylinder portion is located inside the other end plate, and is fixed to the outer rotor. A surface of the outer rotor configures a rotor guide surface that guides an air flow toward a channel provided between adjacent blades. Each blade has a leading edge side portion located radially inside the cylinder portion. An outer end portion of the rotor guide surface in the radial direction is located at the same position in the axial direction as a one side cylinder end portion of the cylinder portion in the axial direction, in a state where a rotor contact portion of the outer rotor and a blade contact portion of the leading edge side portion are in contact with each other.

11 Claims, 18 Drawing Sheets

(51) Int. Cl.

| | |
|---|---|
| ***F04D 29/30*** | (2006.01) |
| ***F04D 29/66*** | (2006.01) |
| ***F04D 25/06*** | (2006.01) |

(52) U.S. Cl.
CPC ..... *F04D 29/28* (2013.01); *F04D 29/30* (2013.01); *F04D 29/66* (2013.01); *F04D 29/666* (2013.01)

(56) References Cited

U.S. PATENT DOCUMENTS

| | | | | |
|---|---|---|---|---|
| 2007/0014675 | A1* | 1/2007 | Nagamatsu ..... | F04D 25/0613<br>417/354 |
| 2014/0010682 | A1 | 1/2014 | Suzuki et al. | |
| 2017/0284420 | A1* | 10/2017 | Nara ..... | F04D 29/666 |
| 2018/0003188 | A1* | 1/2018 | Nara ..... | F04D 17/16 |

FOREIGN PATENT DOCUMENTS

| | | | |
|---|---|---|---|
| JP | 2013060916 | A | 4/2013 |
| JP | 2013117233 | A | 6/2013 |
| JP | 5665802 | B2 | 2/2015 |
| JP | 2016048038 | A | 4/2016 |
| WO | WO-201709347 | A1 | 1/2017 |
| WO | WO-201802790 | A1 | 1/2018 |

* cited by examiner

CENTRIFUGAL BLOWER

CROSS REFERENCE TO RELATED APPLICATIONS

This application is a U.S. National Phase Application under 35 U.S.C. 371 of International Application No. PCT/JP2017/021390 filed on Jun. 8, 2017. This application is based on and claims the benefit of priority from Japanese Patent Application No. 2016-147548 filed on Jul. 27, 2016 and Japanese Patent Application No. 2017-53145 filed on Mar. 17, 2017.

TECHNICAL FIELD

The present disclosure relates to a centrifugal blower.

BACKGROUND ART

Patent Literature 1 discloses a centrifugal blower having a turbo fan. The centrifugal blower of Patent Literature 1 aims at reducing the occurrence of separation of an inflow air from a blade due to the two-dimensional shape. In order to achieve the above object, in the centrifugal blower of Patent Literature 1, a chord line of one side portion located on a fan suction port side of the blade, that is, one side of the blade in a rotation axis direction is offset in a rotational direction from the chord line of the other side portion located on a main plate portion side of the blade, that is, the other side of the blade in the rotation axis direction. In the centrifugal blower, since the blade has a two-dimensional shape, all of one side portion of the blade overlap with the other side portion of the blade in the rotation axis direction.

Patent Literature 2 discloses a centrifugal blower with a turbo fan. In the centrifugal blower of Patent Literature 2, an outer rotor is disposed inside a cylinder portion of the fan. In that state, the outer rotor is fixed to the fan. The outer rotor also serves as a member for guiding an air flow toward the turbo fan. For that reason, a thickness of the centrifugal blower in an axial direction of a rotation shaft can be reduced as compared with a centrifugal blower further including a member for guiding the air flow in addition to the outer rotor.

PRIOR ART LITERATURES

Patent Literature

Patent Literature 1: JP 2013-60916 A
Patent Literature 1: JP 5665802 B2

SUMMARY

However, as a result of the examination by the present inventor, it has been found that even in the conventional turbo fan of Patent Literature 1, the occurrence of separation of the air flow from the blade is insufficiently reduced in the vicinity of a shroud ring. For that reason, the conventional turbo fan described above has insufficient effect of reducing noise.

Further, in the centrifugal blower of Patent Literature 2, it has been found by the present inventor that the following issue occurs. The turbo fan and the outer rotor are assembled together at the time of manufacturing the centrifugal blower. In the assembly, the outer rotor is disposed inside a cylinder portion. At that time, positions of both the turbo fan and the outer rotor in the axial direction of the rotation shaft may be deviated from each other, and a position of a surface of the outer rotor may be lower than an upper end of the cylinder portion. In that case, the air flow guided to the surface of the outer rotor collides with a side surface of the cylinder portion. The noise is increased by inhibiting the air flow in this manner.

In view of the above circumstance, it is a first object of the present disclosure to provide a centrifugal blower capable of reducing separation of an air flow from a blade in the vicinity of a shroud ring as compared with a conventional centrifugal blower. Aside from the above first object, it is a second object of the present disclosure to provide a centrifugal blower capable of reducing a thickness of the centrifugal blower while avoiding the obstruction of the air flow.

To achieve the first object, according to an aspect of the present disclosure, a centrifugal blower for blowing air, includes:

a rotation shaft; and a turbo fan fixed to the rotation shaft to rotate with the rotation shaft.

The turbo fan includes:

a plurality of blades disposed around the rotation shaft;

a shroud ring coupled to a one side blade end portion located on one side of each of the plurality of blades in the rotation axis direction, the shroud ring having an inlet hole into which the air is drawn; and an other end plate coupled to an other side blade end portion located on the other side of each of the plurality of blades in the rotation axis direction, each of the plurality of blades has a blade surface located on a front side of the blade in a rotation direction of the turbo fan, and in an area from an innermost peripheral portion of each of the plurality of blades at a radially innermost side of the turbo fan to a predetermined position of the blade outside the radially innermost peripheral portion, the blade is inclined in a state where at least a part of one side portion located on the one side in the rotation axis direction is located on a front side of an other side portion located on the other side of the one side portion in the rotation axis direction with respect to the blade surface in the rotation axis direction.

According to the above configuration, in a range including an innermost peripheral portion of each of the multiple blades, the blade is inclined so that one side portion is positioned on a front side in the rotation direction with respect to the other side portion. This makes it possible to improve an action of the blades on the inflow air in one side portion. For that reason, the separation of the air flow from the blades in the vicinity of the shroud ring can be reduced as compared with the conventional centrifugal blower.

To achieve the second object, according to another aspect of the present disclosure, a centrifugal blower for blowing air, includes:

a rotation shaft;

an outer rotor of a motor which is fixed to the rotation shaft; and a turbo fan fixed to the outer rotor.

The turbo fan includes:

a plurality of blades disposed around the rotation shaft;

a shroud ring coupled to a one side blade end portion located on one side of each of the plurality of blades in an axial direction of the rotation shaft, the shroud ring having an inlet hole into which air is drawn;

an other end plate coupled to an other side blade end portion located on the other side of each of the plurality of blades in the axial direction; and a cylinder portion that extends from the other blade end portion of each of the plurality of blades to the other side in the axial direction.

The cylinder portion is located inside the other end plate in the radial direction of the turbo fan and fixed to the outer rotor disposed on the inner peripheral side of the cylinder portion.

A surface of the outer rotor on one side in the axial direction configures a rotor guide surface that guides an air flow toward an inter-blade flow channel provided between adjacent blades among the plurality of blades.

Each of the plurality of blades has a leading edge side portion located radially inside the cylinder portion.

An outer end portion of the rotor guide surface in the radial direction is located at the same position in the axial direction as the one side cylinder end portion of the cylinder portion in the axial direction, or at a position on the one side of the cylindrical end portion in the axial direction, in a state where a rotor contact portion of the outer rotor and a blade contact portion of the leading edge side portion are in contact with each other.

According to the above configuration, the outer rotor is disposed inside the cylinder portion at the time of assembling the turbo fan and the outer rotor together. At that time, the rotor contact portion and the blade contact portion are brought into contact with each other. As a result, the positions of the turbo fan and the outer rotor are determined, respectively, in the axial direction of the rotation shaft. The outer end portion of the rotor guide surface is located at the same position in the axial direction as the cylinder end portion, or at a position on the one side in the axial direction from the cylinder end portion. For that reason, the air flow guided to the surface of the outer rotor can be prevented from colliding with a side surface of the cylinder portion.

According to the above configuration, the outer rotor guides the air flow toward an inter-blade flow channel. For that reason, the thickness of the centrifugal blower can be reduced as compared with the case in which the centrifugal blower includes a member for guiding the air flow toward the inter-blade flow channel on one side of the outer rotor in the axial direction.

Therefore, according to the above configuration, the thickness of the centrifugal blower can be reduced while avoiding the obstruction of the air flow.

DESCRIPTION OF EMBODIMENT

Figure 1:
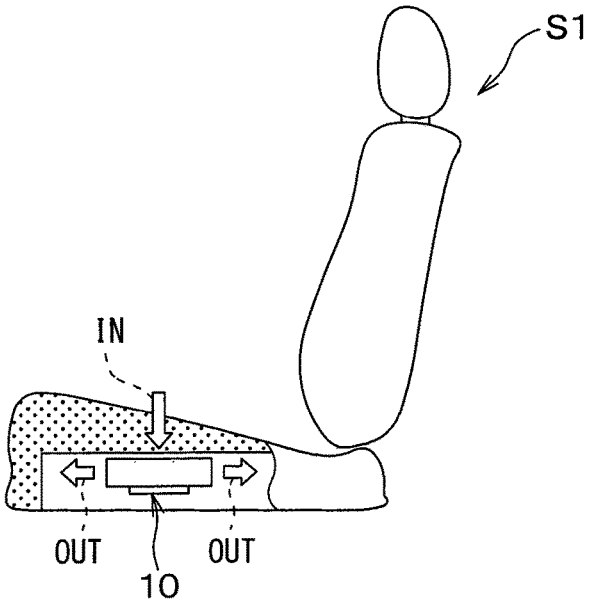
FIG. 1 is a side view and a partial cross-sectional view of a vehicle seat in which a blower according to a first embodiment is disposed.

Hereinafter, embodiments will be described according to the drawings. Same or equivalent portions among respective embodiments below are labeled with same reference numerals in the drawings.

First Embodiment

As shown in FIG. 1, the blower 10 of the present embodiment is used in a seat air conditioner for a vehicle. The blower 10 is housed in a seat 51 on which an occupant sits. The blower 10 draws in an air from a surface of the seat 51 on which the occupant sits. The blower 10 blows out the air inside the seat 51. The air blown out from the blower 10 is discharged from a portion of the seat S 1 other than the surface on which the occupant sits.

Figure 2:
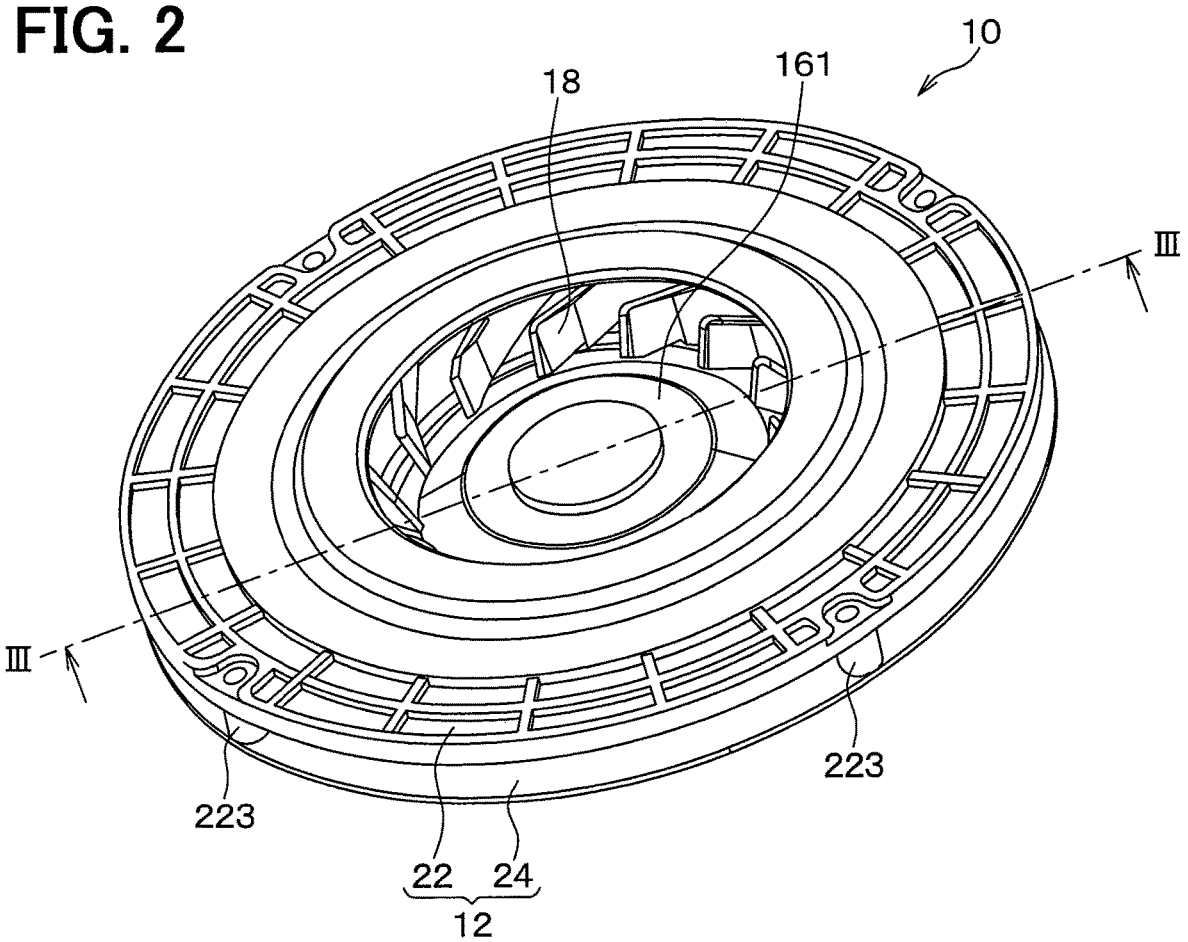
FIG. 2 is a perspective view of the blower according to the first embodiment.
Figure 3:
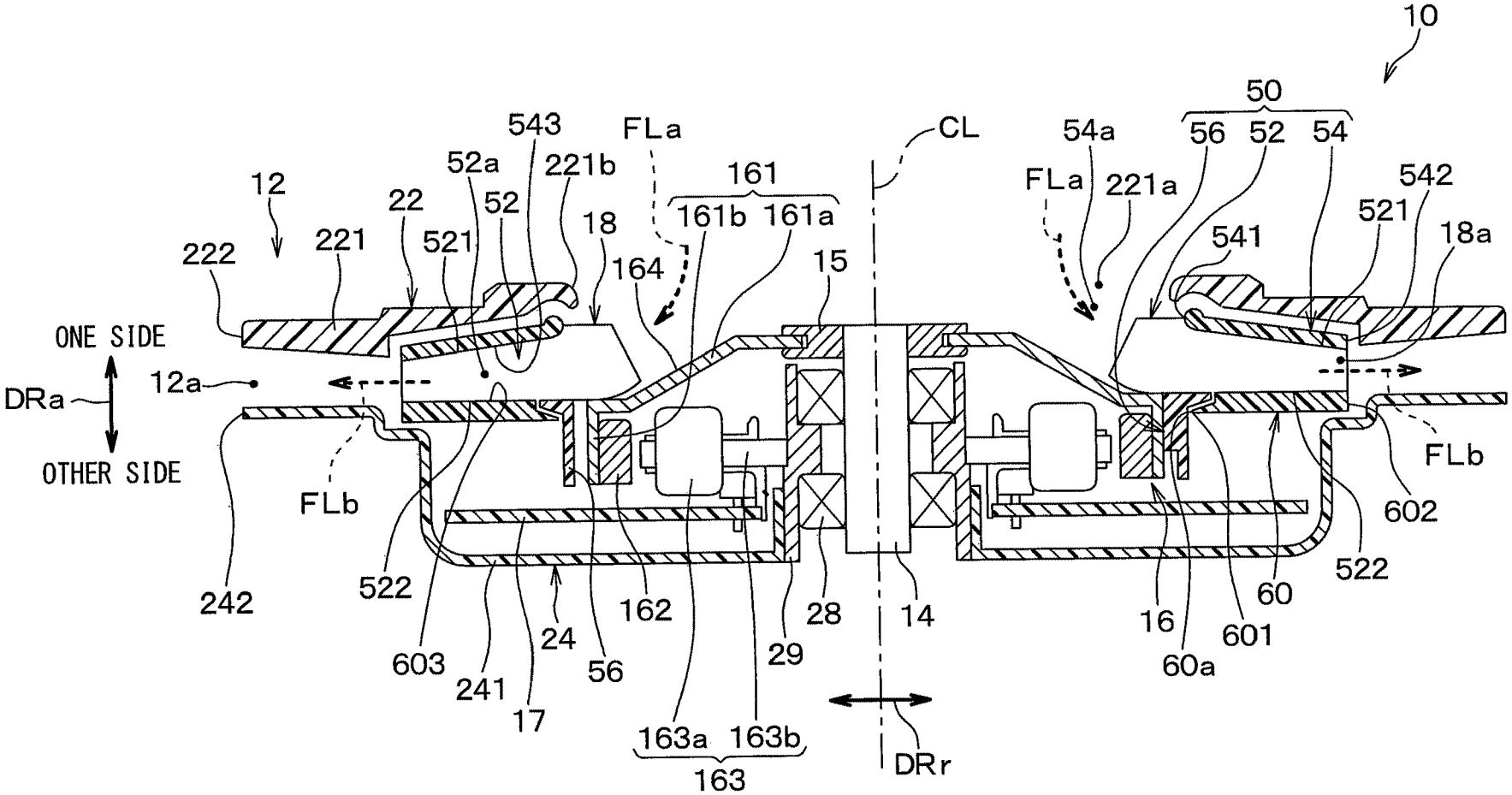
FIG. 3 is a cross-sectional view taken along a line III-III in FIG. 2.

As shown in FIGS. 2 and 3, the blower 10 is a centrifugal blower. In detail, the blower 10 is a turbo type blower. As shown in FIG. 3, the blower 10 includes a casing 12, a rotation shaft 14, a rotation shaft housing 15, an electric motor 16, an electronic board 17, a turbo fan 18, a bearing 28, a bearing housing 29, and the like. An arrow DRa in FIG. 3 indicates a fan axis center direction. A fan axis center CL coincides with an axis center of the rotation shaft 14. The fan axis center direction is also referred to as a rotation axis direction. An arrow DRr in FIG. 3 indicates a fan radial direction. Also, FIG. 3 does not illustrate an exact positional relationship of the components of the blower 10. The exact positional relationship of the components of the blower 10 is illustrated in other figures, such as FIGS. 6 and 8.

The casing 12 is a housing of the blower 10. The casing 12 protects the electric motor 16, the electronic board 17, and the turbo fan 18 from dust and dirt outside the blower 10. For that purpose, the casing 12 houses the electric motor 16, the electronic board 17 and the turbo fan 18. The casing 12 includes a first case member 22 and a second case member 24.

The first case member 22 is made of resin. The first case member 22 has a diameter larger than that of the turbo fan 18 and has a substantially disk shape. The first case member 22 has a first cover portion 221 and a first peripheral portion 222.

The first cover portion 221 is disposed on one side of the turbo fan 18 in the fan axis center direction DRa. An air intake port 221*a* that penetrates the first cover portion 221 in the fan axis center direction DRa is provided on an inner peripheral side of the first cover portion 221. The air is drawn into the turbo fan 18 through the air intake port 221*a*. The first cover portion 221 includes a bell mouth portion 221*b* that configures a peripheral portion of the air intake port 221*a*. The bell mouth portion 221*b* smoothly guides the air flowing from the outside of the blower 10 to the air intake port 221*a* into the air intake port 221*a*. The first peripheral portion 222 forms a peripheral portion of the first case member 22 around the fan axis center CL.

As shown in FIG. 2, the first case member 22 includes multiple support columns 223. The multiple support columns 223 are disposed outside the turbo fan 18 in the fan radial direction DRr. The first case member 22 and the second case member 24 are coupled with each other in a state in which leading edges of the support columns 223 abut against the second case member 24.

The second case member 24 has a substantially disk shape having substantially the same diameter as that of the first case member 22. The second case member 24 is made of resin. The second case member 24 may be made of metal such as iron or stainless steel.

As shown in FIG. 3, the second case member 24 also functions as a motor housing for covering the electric motor 16 and the electronic board 17. The second case member 24 includes a second cover portion 241 and a second peripheral portion 242.

The second cover portion 241 is disposed on the other side in the fan axis center direction DRa with respect to the turbo fan 18 and the electric motor 16. The second cover portion 241 covers the other side of the turbo fan 18 and the electric motor 16. The second peripheral portion 242 forms a peripheral portion of the second case member 24 around the fan axis center CL.

An air blowing port 12*a* for blowing out the air blown out from the turbo fan 18 is provided between the first peripheral portion 222 and the second peripheral portion 242.

Each of the rotation shaft 14 and the rotation shaft housing 15 is made of a metal such as iron, stainless steel, or brass. The rotation shaft 14 is a rod member having a cylindrical shape. The rotation shaft 14 is fixed by being press-fitted into each of the rotation shaft housing 15 and an inner ring of the bearing 28. An outer ring of the bearing 28 is fixed by being press-fitted into the bearing housing 29. The bearing housing 29 is fixed to the second cover portion 241. The bearing housing 29 is made of a metal such as aluminum alloy, brass, iron, or stainless steel.

Therefore, the rotation shaft 14 and the rotation shaft housing 15 are supported by the second cover portion 241 through the bearing 28. In other words, the rotation shaft 14 and the rotation shaft housing 15 are rotatable about the fan axis center CL with respect to the second cover portion 241.

The electric motor 16 is an outer rotor type brushless DC motor. The electric motor 16 includes a motor rotor 161, a rotor magnet 162, and a motor stator 163.

The motor rotor 161 is an outer rotor disposed outside the fan radial direction DRr of the motor stator 163. The motor rotor 161 is formed of a metal plate such as a steel plate. The motor rotor 161 is formed by pressing a metal plate. The motor rotor 161 includes a rotor main body portion 161*a* and a rotor outer peripheral portion 161*b*.

The rotor main body portion 161*a* has a disk shape having an opening at a center. The rotor main body portion 161*a* is shaped to be inclined to the other side in the fan axis center direction DRa from the inside toward the outside in the fan radial direction DRr. An open end portion of the rotor main body portion 161*a* is clamped to the rotation shaft housing 15. As a result, the motor rotor 161 and the rotation shaft housing 15 are fixed to each other. In other words, the motor rotor 161 is fixed to the rotation shaft 14 through the rotation shaft housing 15.

A surface of the rotor main body portion 161*a* on one side in the fan axis center direction DRa configures an air flow guide surface 164 for guiding an air flow. The air flow guide surface 164 guides the air flow drawn from the air intake port 221*a* and directed in the fan axis center direction DRa to the outside of the fan radial direction DRr.

The rotor outer peripheral portion 161*b* is located at an outer peripheral end portion of the rotor main body portion 161*a* in the fan radial direction DRr. The rotor outer peripheral portion 161*b* extends in a cylindrical shape from the outer peripheral end portion of the rotor main body portion 161*a* to the other side of the fan axis center direction DRa. The rotor outer peripheral portion 161*b* is press-fitted to the inner peripheral side of the rotor housing portion 56 of the turbo fan 18, which will be described later. As a result, the turbo fan 18 and the motor rotor 161 are fixed to each other.

In this manner, the turbo fan 18 and the motor rotor 161 are fixed to the rotation shaft 14 rotatable about the fan axis center CL through the rotation shaft housing 15. For that reason, the turbo fan 18 and the motor rotor 161 are rotatably supported around the fan axis center CL with respect to the casing 12 as a non-rotating member of the blower 10.

The rotor magnet 162 is a permanent magnet, and is formed of a rubber magnet containing, for example, ferrite, neodymium, or the like. The rotor magnet 162 is fixed to the inner peripheral surface of the rotor outer peripheral portion 161*b*. Therefore, the motor rotor 161 and the rotor magnet 162 rotate integrally with the turbo fan 18 about the fan axis center CL.

The motor stator 163 includes a stator coil 163*a* and a stator core 163*b* which are electrically connected to the electronic board 17. The motor stator 163 is disposed radially inward with a small gap with respect to the rotor magnet 162. The motor stator 163 is fixed to the second cover portion 241 of the second case member 24 through the bearing housing 29.

In the electric motor 16 configured as described above, when the stator coil 163*a* of the motor stator 163 is energized by an external power supply, a change in magnetic flux occurs in the stator core 163*b* by the stator coil 163*a*. The change in magnetic flux in the stator core 163*b* generates a force to attract the rotor magnet 162. Therefore, the motor rotor 161 receives a force to attract the rotor magnet 162, and performs a rotational motion around the fan axis center CL. In short, the electric motor 16 is energized to rotate the turbo fan 18 to which the motor rotor 161 is fixed about the fan axis center CL.

Figure 4:
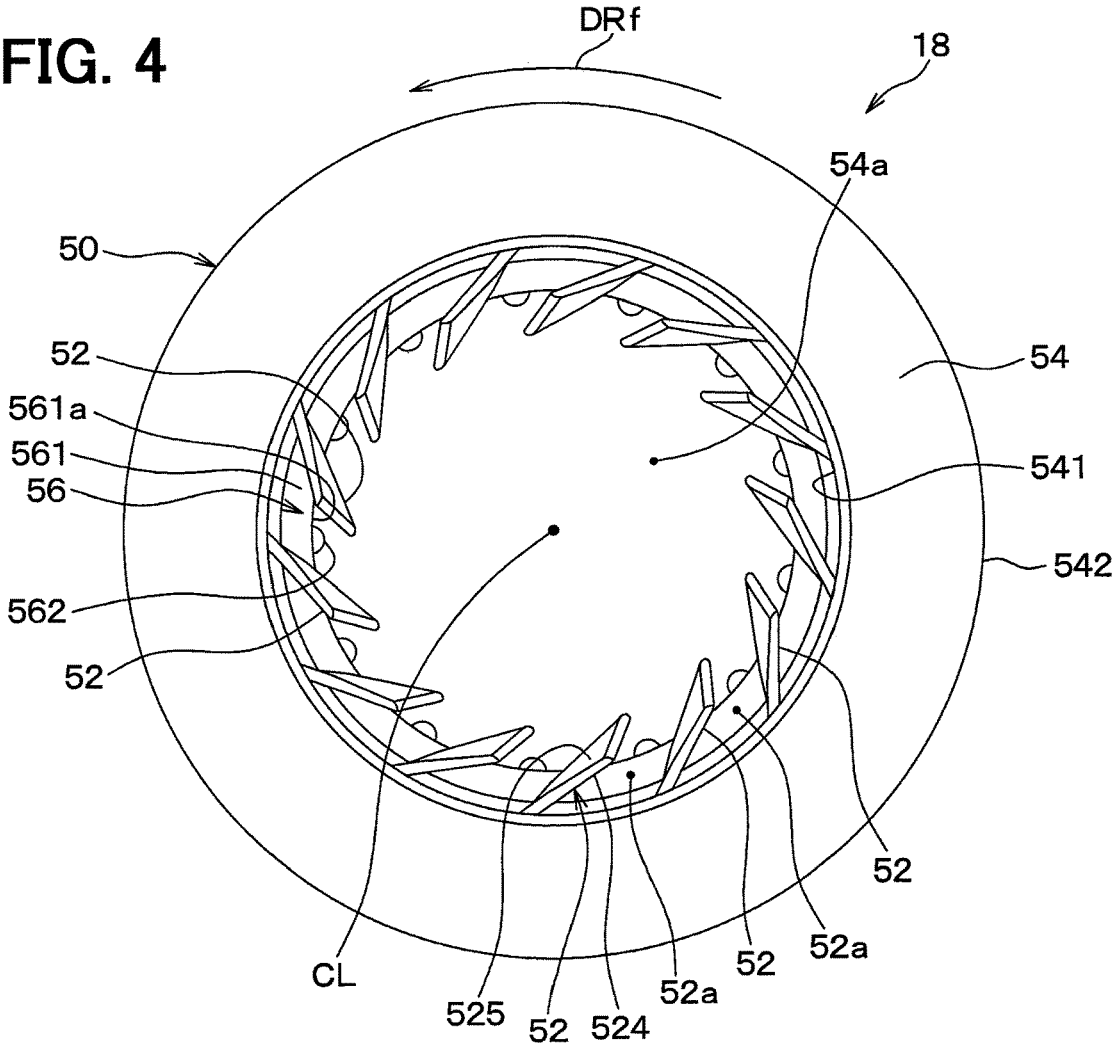
FIG. 4 is a top view of a turbo fan in FIG. 3.
Figure 5:
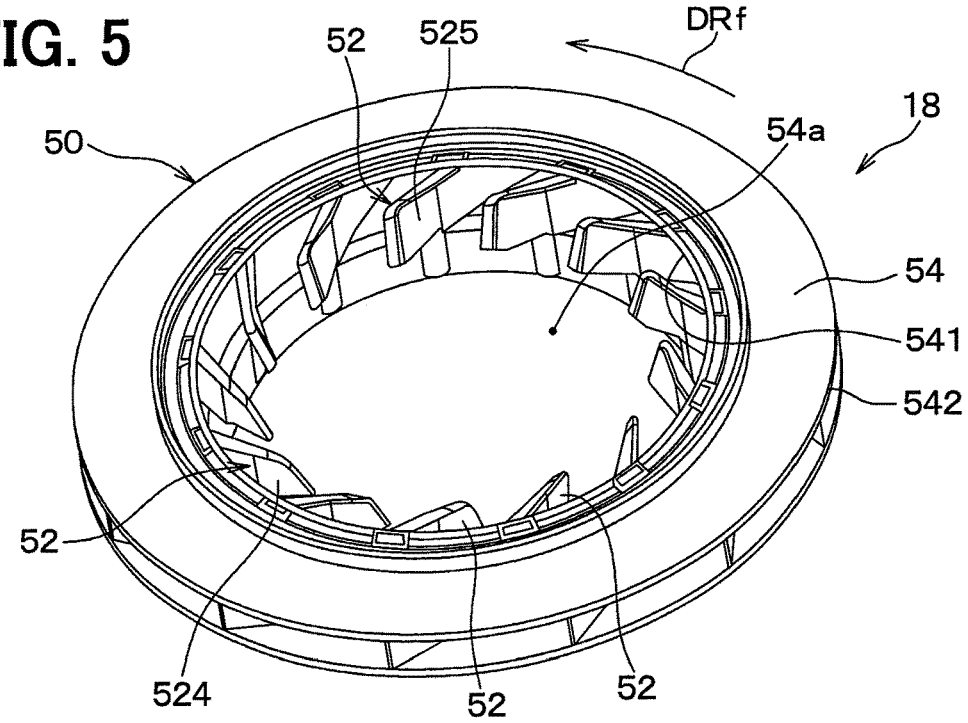
FIG. 5 is a perspective view of the turbo fan in FIG. 3.

As shown in FIGS. 3, 4 and 5, the turbo fan 18 is an impeller applied to the blower 10. As shown in FIG. 4, the turbo fan 18 rotates around the fan axis center CL in a predetermined fan rotation direction DRf to blow the air. In other words, the turbo fan 18 rotates around the fan axis center CL to draw the air from one side in the fan axis center direction DRa through the air intake port 221*a* as indicated by an arrow FLa in FIG. 3. The turbo fan 18 blows out the drawn air to the outer peripheral side of the turbo fan 18 as indicated by an arrow FLb in FIG. 3.

More specifically, as shown in FIG. 3, the turbo fan 18 includes a fan main body member 50 and the other end plate 60.

The fan main body member 50 includes multiple blades 52, a shroud ring 54, and the rotor housing portion 56. The fan main body member 50 is made of resin. The fan main body member 50 is formed by one injection molding. In other words, the multiple blades 52, the shroud ring 54, and the rotor housing portion 56 are formed as an integral molded product. Accordingly, the multiple blades 52, the shroud ring 54, and the rotor housing portion 56 are continuous with each other, and are all made of the same material. For that reason, in the fan main body member 50, there is no joint portion provided between the multiple blades 52 and the shroud ring 54 and joining the multiple blades 52 and the shroud ring 54, and there is also no joint portion provided between the multiple blades 52 and the rotor housing portion 56 and joining the multiple blades 52 and the rotor housing portion 56.

The multiple blades 52 are disposed about the rotation shaft 14. In other words, the multiple blades 52 are disposed around the fan axis center CL. More specifically, the multiple blades 52 are disposed side by side in a circumferential direction of the fan axis center CL with a space between the respective blades 52 through which the air flows.

Each blade 52 has a one side blade end portion 521 provided on one side of the blade 52 in the fan axis center direction DRa. Each blade 52 has an other side blade end portion 522 provided on the other side of the blade 52 opposite to the one side in the fan axis center direction DRa.

As shown in FIG. 4, each blade 52 has a positive pressure surface 524 and a negative pressure surface 525 that configure a blade shape. The positive pressure surface 524 is a first blade surface located on a front side in the fan rotation direction DRr. The negative pressure surface 525 is a second blade surface located on a rear side in the fan rotation direction DRr. The multiple blades 52 form inter-blade flow channels 52*a* through which the air flows between the blades 52 adjacent to each other among the multiple blades 52.

As shown in FIGS. 4 and 5, the shroud ring 54 is shaped to extend in a disk shape in the fan radial direction DRr. An inlet hole 54*a* into which the air from the air intake port 221*a* of the casing 12 is drawn as indicated by an arrow FLa in FIG. 3 is provided on an inner peripheral side of the shroud ring 54. Thus, the shroud ring 54 has an annular shape.

The shroud ring 54 has a ring inner peripheral end portion 541 and a ring outer peripheral end portion 542. The ring inner peripheral end portion 541 is an end portion of the shroud ring 54 provided inside in the fan radial direction DRr, and provides the inlet hole 54*a*. The ring outer peripheral end portion 542 is an end portion of the shroud ring 54 that is provided outside in the fan radial direction DRr.

As shown in FIG. 3, the shroud ring 54 is provided on one side of the multiple blades 52 in the fan axis center direction DRa, that is, on the air intake port 221*a* side. The shroud ring 54 is coupled to the one side blade end portion 521 of each of the multiple blades 52.

The rotor housing portion 56 has a cylindrical shape centered on the fan axis center CL. The rotor housing portion 56 is coupled to the other side blade end portion 522 of each of the multiple blades 52. In other words, the rotor housing portion 56 is a cylinder portion extending in a cylindrical shape from the other side blade end portion 522 to the other side in the fan axis center direction DRa. The rotor housing portion 56 stores the motor rotor 161 on the inner peripheral side of the rotor housing portion 56.

As shown in FIG. 4, the rotor housing portion 56 includes a main body portion 561 and multiple ribs 562. The main body portion 561 is cylindrical and has an inner peripheral surface 561*a*. The multiple ribs 562 are multiple protrusion portions protruding from the inner peripheral surface 561*a*. Each of the multiple ribs 562 is arranged in the circumferential direction of the main body portion 561 with a space therebetween. In the present embodiment, each of the multiple ribs 562 is provided between the respective blades 52 disposed in the circumferential direction.

Figure 6:
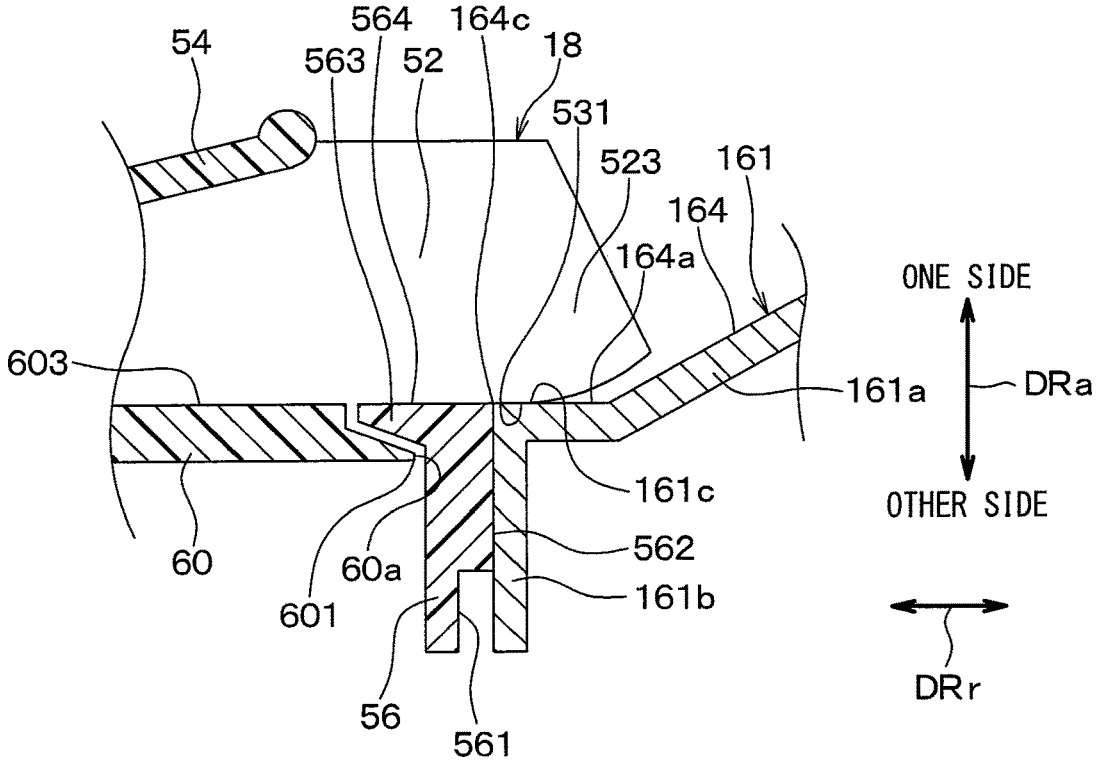
FIG. 6 is an enlarged cross-sectional view of a periphery of a rotor housing portion of the blower according to the first embodiment.
Figure 7:
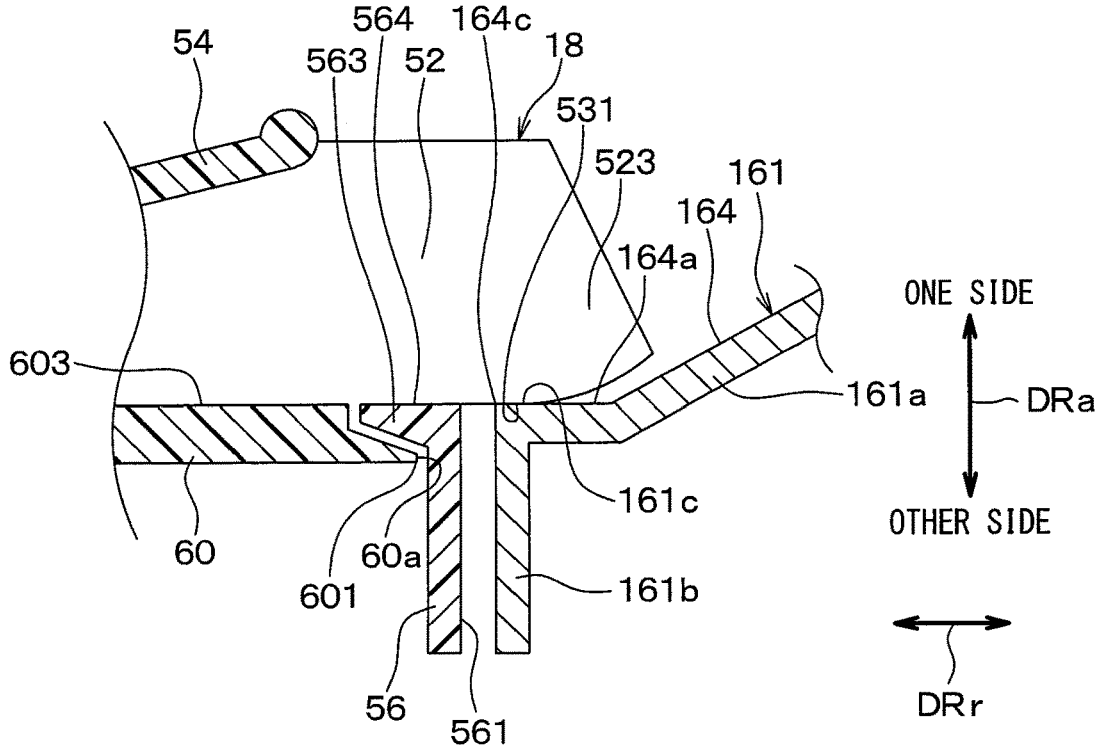
FIG. 7 is an enlarged cross-sectional view of the periphery of a rotor housing portion of the blower according to the first embodiment, which is a cross-sectional view at a position different from that of FIG. 6.

As shown in FIG. 6, the multiple ribs 562 extend from one end of the main body portion 561 in the fan axial direction DRa to the other end portion of the fan axial direction DRa. The rotor outer peripheral portion 161*b* is press-fitted inside the multiple ribs 562. As a result, the rotor outer peripheral portion 161*b* is fixed to the inner peripheral side of the rotor housing portion 56 in a state in which the multiple ribs 562 are in contact with the rotor outer peripheral portion 161*b*. As shown in FIG. 7, a portion of the inner peripheral surface 561*a* where the multiple ribs 562 are not provided is out of contact with the rotor outer peripheral portion 161*b*.

In the present embodiment, the multiple blades 52 are connected to both of the shroud ring 54 and the rotor housing portion 56. In other words, the multiple blades 52 also function as coupling ribs for bridging and coupling the shroud ring 54 and the rotor housing portion 56. For that reason, the multiple blades 52, the shroud ring 54, and the rotor housing portion 56 can be integrally molded with each other.

Figure 8:
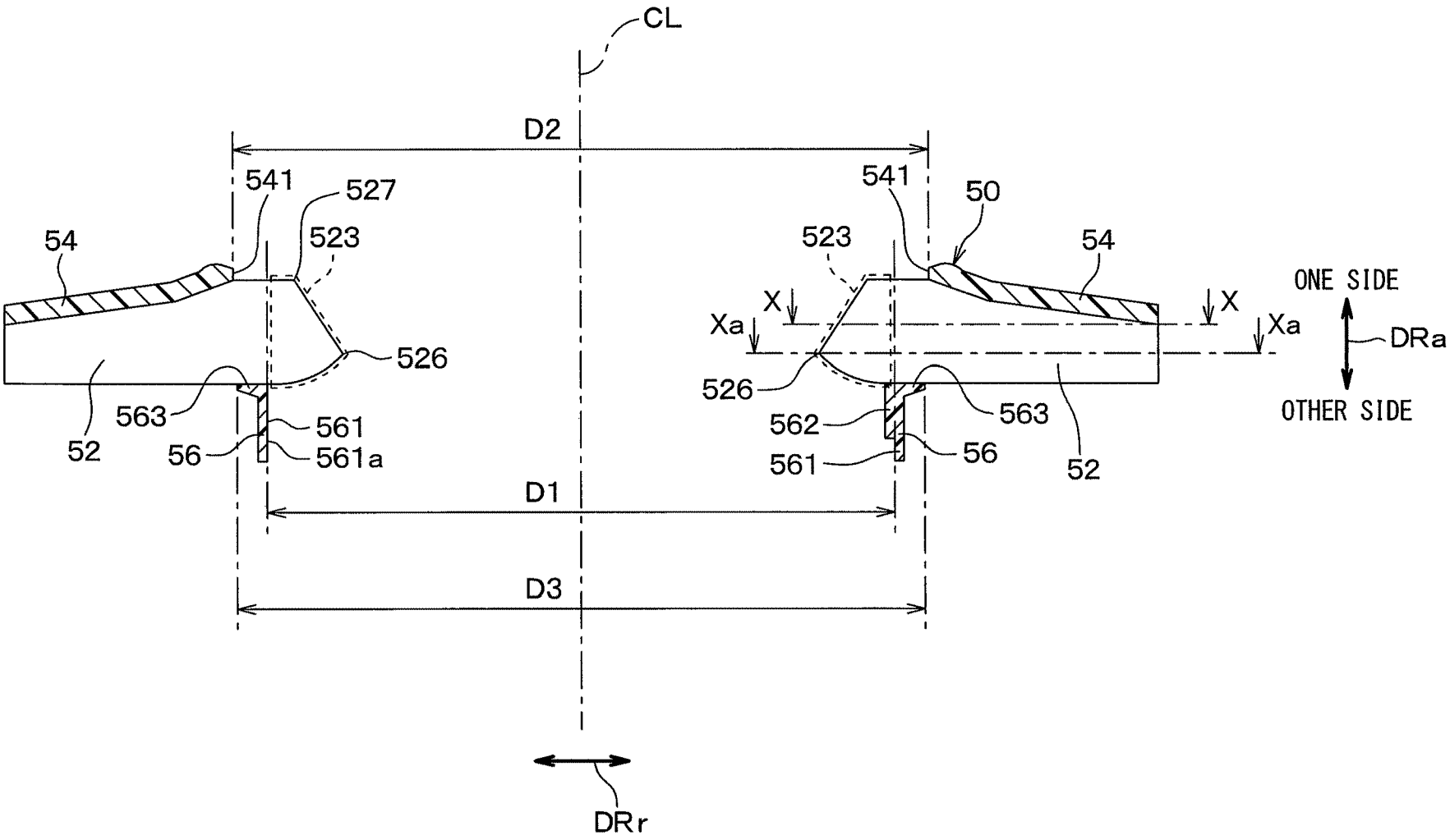
FIG. 8 is a cross-sectional view of a fan main body member according to the first embodiment.

Further, as shown in FIG. 8, the overall rotor housing portion 56 is disposed inside the ring inner peripheral end portion 541 of the shroud ring 54 in the fan radial direction DRr. In other words, an outermost diameter D3 of the rotor housing portion 56 is smaller than a minimum inner diameter D2 of the shroud ring 54 (that is, D3<D2). In the present embodiment, the outermost diameter D3 of the rotor housing portion 56 is an outer diameter of a joint portion 563 that is joined to the other end plate 60 of the rotor housing portion 56. As a result, the fan main body member 50 can be integrally molded with the fan axis center direction DRa as a die cutting direction. The die cutting direction is a movement direction of a die with respect to the molded article when the die for molding is detached from the molded article.

The other end plate 60 shown in FIG. 3 has a shape extending in a disk shape in the fan radial direction DRr. A side plate fitting hole 60*a* that penetrates the other end plate 60 in the thickness direction is provided on the inner peripheral side of the other end plate 60. Therefore, the other end plate 60 has an annular shape. The other end plate 60 is a resin molded product molded separately from the fan main body member 50.

The other end plate 60 is joined to the other side blade end portion 522 of each of the multiple blades 52. As a result, the other end plate 60 is fixed to the other side blade end portion 522 of each of the multiple blades 52.

The other end plate 60 is joined to each of the blades 52 by, for example, vibration welding or heat welding. Therefore, in view of the bonding property by welding of the other end plate 60 and the blade 52, the other end plate 60 and the fan main body member 50 are preferably made of thermoplastic resin, and more preferably made of the same kind of material.

The turbo fan 18 is completed as a closed fan by joining the other end plate 60 to the blade 52 in this manner. The closed fan is a turbo fan in which both sides of the inter-blade flow channel 52*a* provided between the adjacent multiple blades 52 in the fan axis center direction DRa are covered with the shroud ring 54 and the other end plate 60. In other words, the shroud ring 54 has a ring guide surface 543 that faces the inter-blade flow channels 52*a* and guides the air flow in the inter-blade flow channel 52*a*. The other end plate 60 has a side plate guide surface 603 that faces the inter-blade flow channels 52*a* and guides the air flow in the inter-blade flow channels 52*a*.

The side plate guide surface 603 faces the ring guide surface 543 across the inter-blade flow channel 52*a*, and is disposed outside the air flow guide surface 164 in the fan radial direction DRr. The side plate guide surface 603 serves to smoothly guide the air flow along the air flow guide surface 164 to a blowing port 18*a*.

The other end plate 60 has a side plate inner peripheral end portion 601 and a side plate outer peripheral end portion 602. The side plate inner peripheral end portion 601 is an end portion of the other end plate 60 provided on the inner side in the fan radial direction DRr, and provides the side plate fitting hole 60*a*. As shown in FIGS. 6 and 7, the side plate inner peripheral end portion 601 is joined to the joint portion 563 of the rotor housing portion 56. In FIGS. 6 and 7, the side plate inner peripheral end portion 601 and the joint portion 563 are illustrated separated from each other so that the side plate inner peripheral end portion 601 and the joint portion 563 can be easily seen. The side plate outer peripheral end portion 602 is an end portion of the other end plate 60 provided outside in the fan radial direction DRr.

The side plate outer peripheral end portion 602 and the ring outer peripheral end portion 542 are disposed apart from each other in the fan axis center direction DRa. The side plate outer peripheral end portion 602 and the ring outer peripheral end portion 542 provide the blowing port 18*a*, from which the air having passed through the inter-blade flow channels 52*a* is blown out, between the side plate outer peripheral end portion 602 and the ring outer peripheral end portion 542.

As shown in FIG. 8, a leading edge side portion 523 of each of the multiple blades 52 protrudes inward from the inner peripheral surface 561*a* of the rotor housing portion 56 in the fan radial direction DRr. The leading edge side portion 523 extends from the position of the innermost peripheral portion 526 of each blade 52 in the fan radial direction DRr to a predetermined position inside the inner peripheral surface 561*a* of the rotor housing portion 56. The innermost peripheral portion 526 is an inner peripheral portion of each blade 52 located innermost in the fan radial direction DRr.

Figure 9A:
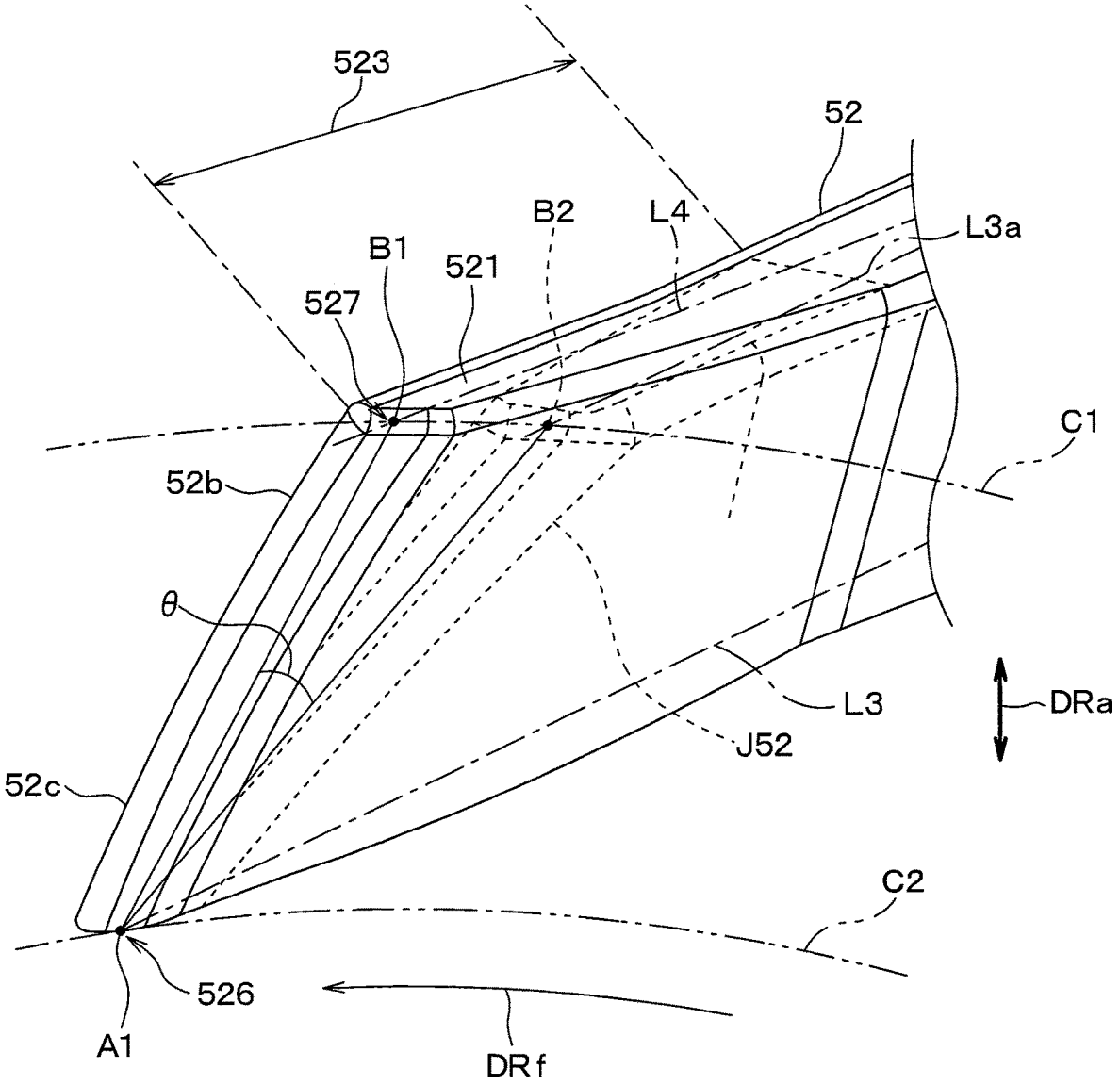
FIG. 9A is a perspective view of a leading edge side portion of the blade viewed from an inside in a fan radial direction according to the first embodiment.

As shown in FIG. 9A, in the leading edge side portion 523 of each of the multiple blades 52, the blade 52 is inclined to a front side of the fan rotation direction DRf so that a blade upper portion 52*b* is positioned on a front side of a blade lower portion 52*c* in the fan rotation direction DRf. The blade upper portion 52*b* is a one side portion of the blade 52 located on one side of the fan axial direction DRa. The blade lower portion 52*c* is the other side portion located on the other side of the blade 52 in the fan axial direction DRa with respect to one side portion. C1 and C2 in FIG. 9A are virtual inscribed circles C1 and C2 in FIG. 9B.

Figure 10:
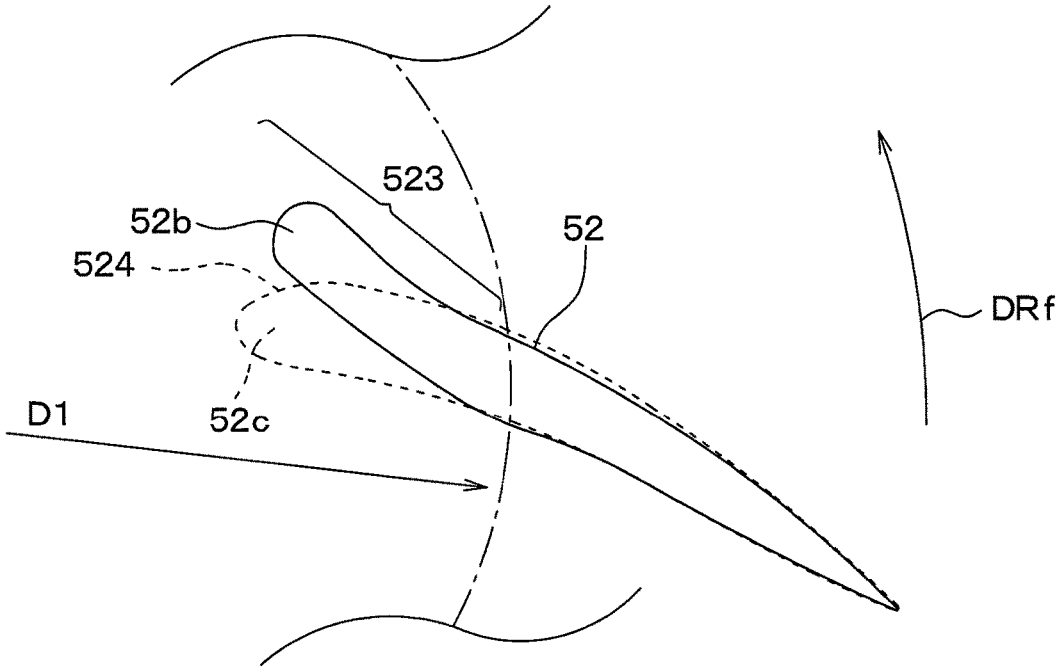
FIG. 10 is a diagram in which a cross-sectional view taken along a line Xa-Xa in FIG. 8 is superimposed on a cross-sectional view taken along a line X-X in FIG. 8.

The recitation that the blade upper portion 52*b* is positioned on the front side of the blade lower portion 52*c* in the fan rotation direction DRf means that at least a part of the blade upper portion 52*b* is positioned on the front side of the fan rotation direction DRf with respect to the positive pressure surface 524 of the blade lower portion 52*c* as shown in FIG. 10. FIG. 10 is a diagram in which a cross-sectional view taken along a line Xa-Xa in FIG. 8 indicated by a broken line is superimposed on a cross-sectional view taken along a line X-X in FIG. 8 indicated by a solid line.

In addition, the recitation that the blade upper portion 52*b* is positioned on the front side of the blade lower portion 52*c* in the fan rotation direction DRf can be stated in the following manner. A cross section of the blade 52 orthogonal to the fan axis center direction DRa at a position on the other end side in the fan axis center direction DRa is projected in parallel to the fan axis center direction DRa on a cross-section of the blade 52 on one end side orthogonal to the fan axis center direction DRa at a position on one end side in the fan axis center direction DRa. At that time, a part of the blade 52 on one end side protrudes from the blade 52 on the other end side toward the front side in the fan rotation direction DRf.

Further, the recitation that the blade 52 is inclined to the front side on the fan rotation direction DRf means that an inner end portion of the blade 52 in the fan radial direction DRr is positioned on the front side of the fan rotation direction DRf as the inner end portion is moved toward one side of the fan axis center direction DRa. In this manner, the leading edge side portion 523 has a shape twisted forward in the rotation direction.

As shown in FIG. 3, the turbo fan 18 configured in this manner rotates in the fan rotation direction DRf integrally with the motor rotor 161. Accordingly, the blades 52 of the turbo fan 18 impart momentum to the air. As a result, the turbo fan 18 blows the air radially outward from the blowing port 18*a* opened at the outer periphery of the turbo fan 18. At this time, the air drawn from the inlet hole 54*a* and sent out by the blades 52, that is, the air blown out from the blowing port 18*a* is discharged to the outside of the blower 10 through the air blowing port 12*a* provided by the casing 12.

Figure 11:
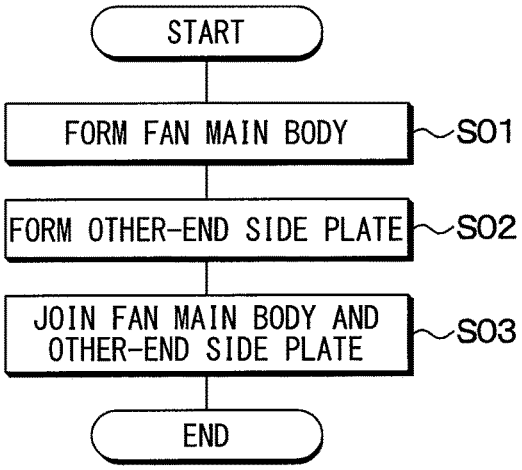
FIG. 11 is a flowchart showing a manufacturing process of the blower according to the first embodiment.

Next, a method of manufacturing the turbo fan 18 will be described with reference to a flowchart of FIG. 11. As shown in FIG. 11, first, in Step S01 as a fan main body molding process, the fan main body member 50 is molded. That is, the multiple blades 52, the shroud ring 54, and the rotor housing portion 56, which are components of the fan main body member 50, are integrally molded.

Specifically, the multiple blades 52, the shroud ring 54, and the rotor housing portion 56 are integrally molded by injection molding using a thermoplastic resin with a pair of molding dies that open and close in the fan axis center direction DRa. The pair of molding dies includes one side die and the other side die. The other side mold is a mold provided on the other side with respect to the one side mold in the fan axis center direction DRa.

In the leading edge side portion 523, the positive pressure surface 524 faces the other side in the fan axis center direction DRa. For that reason, the positive pressure surface 524 of the leading edge side portion 523 is molded by the other side mold. In the leading edge side portion 523, the negative pressure surface 525 faces one side in the fan axis center direction DRa. For that reason, the negative pressure surface 525 of the leading edge side portion 523 is molded by a one-side mold.

In this step, a heated and melted thermoplastic resin is injected between a pair of molding dies. After the injected thermoplastic resin has solidified, the pair of molding dies are opened. In other words, the pair of molding dies are moved from the solidified molded product in the fan axis center direction DRa. As a result, the pair of molding dies are separated from the molded product.

After Step S01, the process proceeds to Step S02. In Step S02 as the other-end side plate molding process, the other end plate 60 is molded by, for example, injection molding. It should be noted that either Step S01 or Step S02 may be first executed.

After Step S02, the process proceeds to Step S03. In step S03 as a bonding process, the other end plate 60 is bonded to each of the other side blade end portions 522 of the blade 52. The blade 52 and the other end plate 60 are joined together by, for example, vibration welding or heat welding. When the above Step S03 is completed, the turbo fan 18 is completed.

As described above, in the present embodiment, in the leading edge side portion 523 of each of the multiple blades 52, the blade 52 is inclined to the front side in the rotation direction so that the blade upper portion 52*b* is positioned on the front side of the blade lower portion 52*c* in the fan rotation direction DRf.

Figure 12:
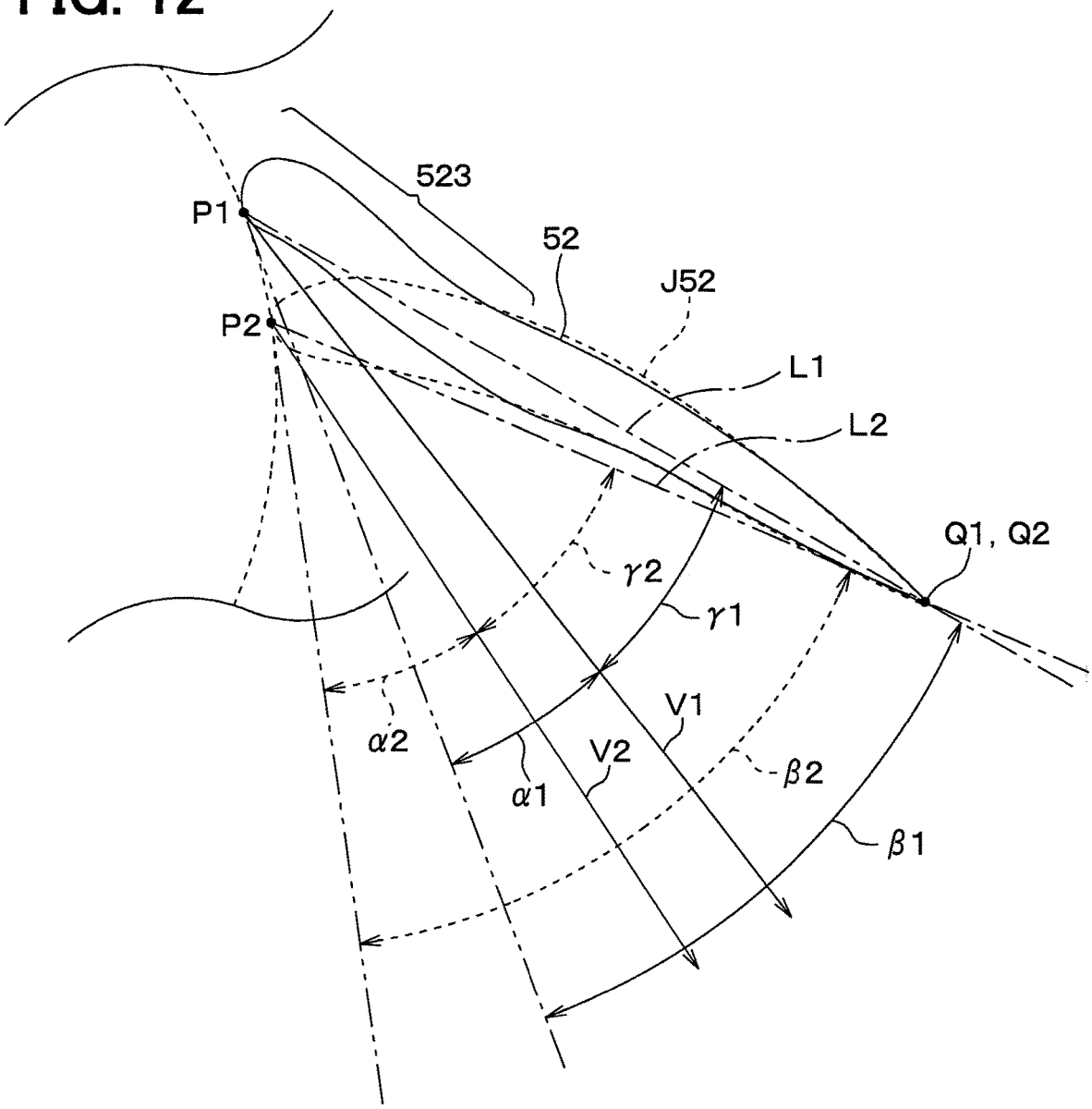
FIG. 12 is a diagram in which a cross-sectional view of a blade upper portion of Comparative Example 1 is superimposed on a cross-sectional view of a blade upper portion in the first embodiment.

As a result, the action of the blade 52 on the inflow air in the blade upper portion 52*b* can be improved. In other words, as shown in FIG. 12, according to the present embodiment, an entrance angle β1 of the blade 52 in the blade upper portion 52*b* can be set to be smaller than an entrance angle β2 of the blade J52 in a blade upper portion in Comparative Example 1 shown in FIG. 13. For that reason, according to the present embodiment, an incident angle γ1 of the inflow air to the blade 52 in the blade upper portion 52*b* can be set to be smaller than an incident angle γ2 of the inflow air to a blade J52 in the blade upper portion of Comparative Example 1.

Figure 13:
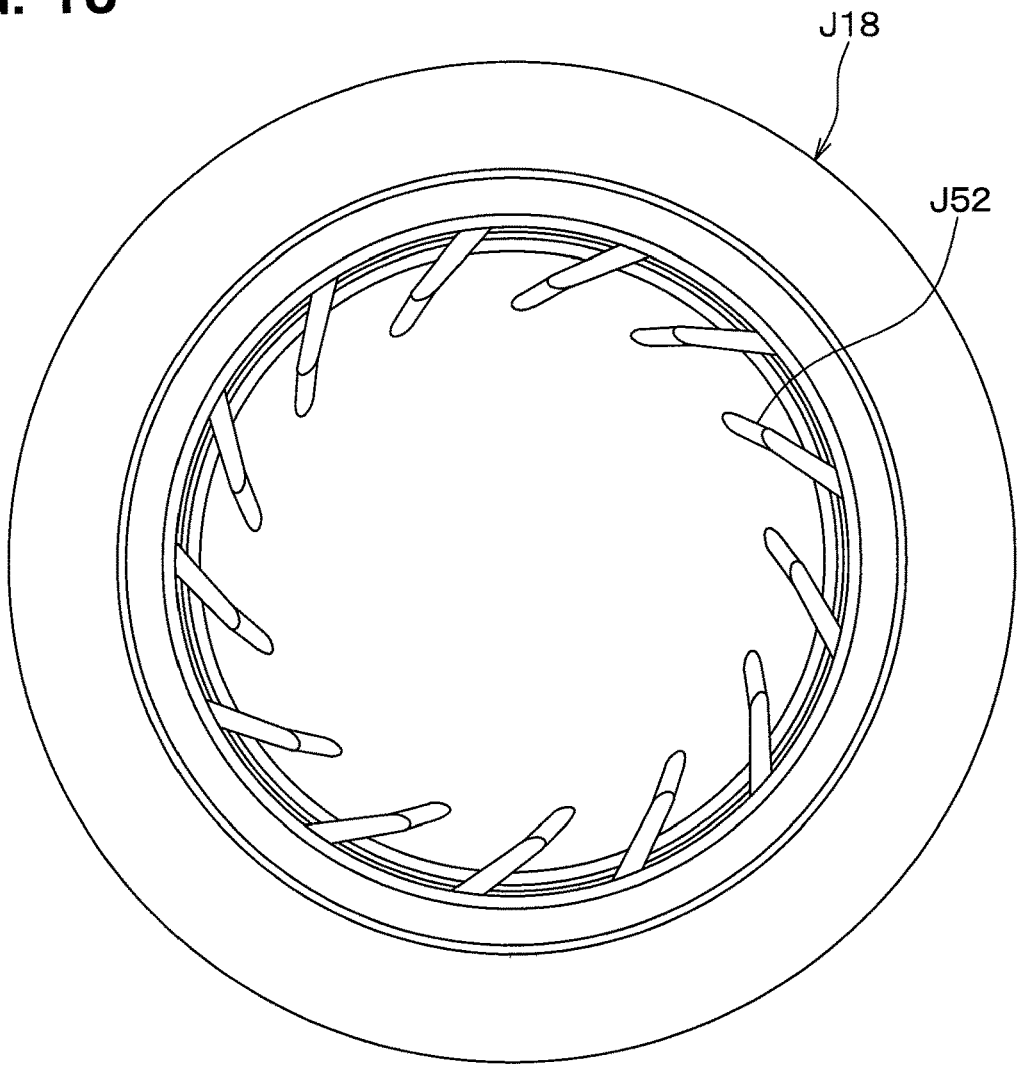
FIG. 13 is a top view of a turbo fan in Comparative Example 1.

The turbo fan J18 in Comparative Example 1 is different from the turbo fan 18 of the present embodiment in that, as shown in FIG. 13, a leading edge side portion of the blade J52 of a turbo fan J18 is not inclined toward the front side in the fan rotation direction DRf. The blade 52 shown by a solid line in FIG. 12 shows the same cross section of the blade 52 as in FIG. 10. The blade J52 indicated by a broken line in FIG. 12 shows a cross section at the same position in the fan axial direction DRa as in the present embodiment.

The entrance angles β1 and β2 in FIG. 12 are angles formed by tangents of an inscribed circle at inner peripheral portions P1 and P2 of the blades 52 and J52 and chord lines L1 and L2. The inscribed circle is a virtual circle that contacts each of the multiple blades 52 and J52 on the inner side in the fan radial direction DRr. The inner peripheral portions P1 and P2 are portions of the blades 52 and J52 that are in contact with the inscribed circle. The tangent of the inscribed circle is a two-dot chain line in FIG. 12. The chord lines L1 and L2 are dot-dash lines in FIG. 12. The chord lines L1 and L2 are straight lines connecting the inner peripheral portions P1 and P2 of the blades 52 and J52 and outer peripheral portions Q1 and Q2, respectively.

The incident angles γ1 and γ2 in FIG. 12 are differences between the inflow angles α1 and α2 of the inflow air and entrance angles β1 and β2 at the inner peripheral portions P1 and P2 of the blades 52 and J52, respectively. The inflow angles α1 and α2 are angles formed by the tangents of the inscribed circle at the positions of the inner peripheral portions P1 and P2 of the blades 52 and J52 and directions of flow velocity vectors V1 and V2 of the inflow air.

Figure 14:
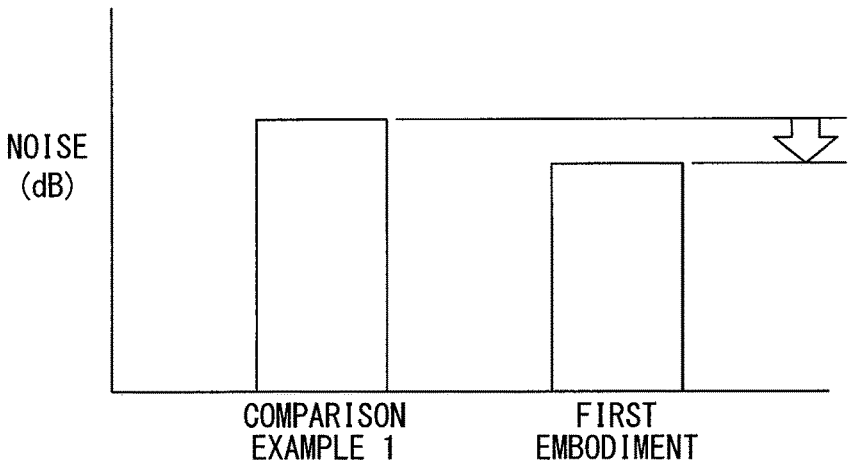
FIG. 14 is a diagram showing a result of measuring noise under the same measurement conditions for each of the blower of the first embodiment and the blower of Comparative Example 1.

Therefore, according to the present embodiment, separation of the air flow generated in the vicinity of the shroud ring 54 from the blades 52 can be reduced. As a result, as shown in FIG. 14, according to the present embodiment, noise can be reduced as compared with Comparative Example 1.

Now, a relationship between an inclination angle θ of the blade 52 and a noise reduction effect according to the present embodiment will be described with reference to FIG. 15. The inclination angle θ of the blade 52 indicates the degree of inclination of the blade 52, indicated in solid lines in FIG. 9A, relative to the blade J52, indicated in a dashed line in FIG. 9A. The blade J52 indicated by a broken line in FIG. 9A is the blade J52 of Comparative Example 1.

Specifically, the innermost peripheral portion 526 is set as a base point A1. A one side edge portion 527 located inside the one side blade end portion 521 in the fan radial direction DRr is defined as a first point B1. Further, a chord line L3 at a position of the innermost peripheral portion 526 is projected parallel to the fan axis center direction DRa on a plane passing through the first point B1 and perpendicular to the fan axis center direction DRa. An intersection of the projected chord line L3*a* and the virtual inscribed circle C1 that passes through the first point B1 and contacts the inside of each of the multiple blades 52 in the fan radial direction DRr is referred to as a second point B2. At that time, an angle formed by a straight line connecting the base point A1 and the first point B1 and a straight line connecting the base point A1 and the second point B2 on a plane passing through three points of the base point A1, the first point B1, and the second point B2 is the inclination angle θ of the blade 52.

Figure 9B:
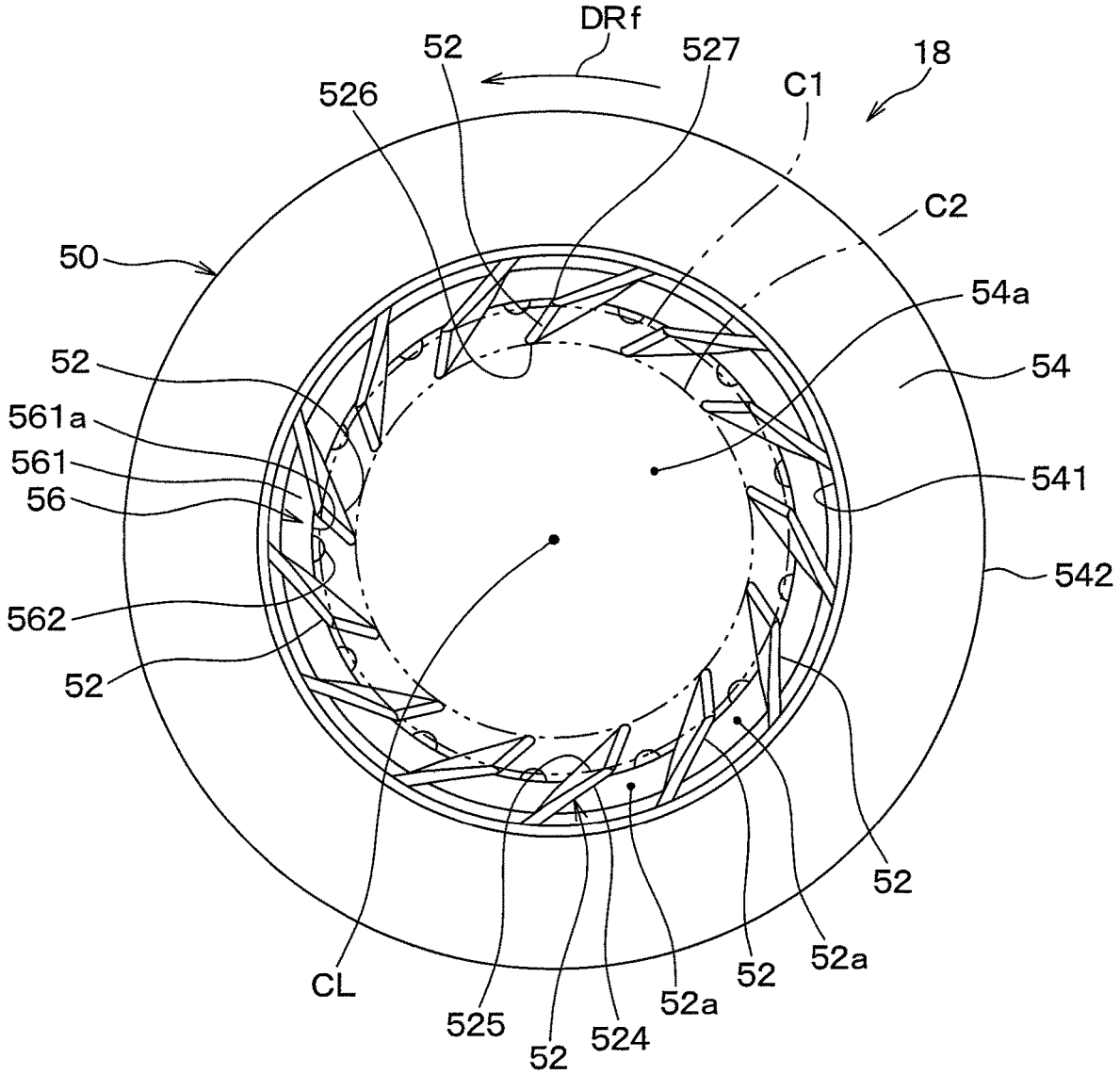
FIG. 9B is a top view of the turbo fan corresponding to FIG. 4, showing a virtual inscribed circle in contact with an innermost peripheral portion of the blade and a virtual inscribed circle in contact with a one side edge portion of the blade.

As shown in FIG. 9B, the innermost peripheral portion 526 is a contact point between the virtual inscribed circle C2 contacting each of the multiple blades 52 at the position of the other side end portion in the fan axis center direction DRa on the inner side of the fan radial direction DRr and the blade 52. In other words, the innermost peripheral portion 526 is an intersection of the virtual inscribed circle C2 at that position in the fan axis center direction DRa and the chord line L3 at that position. The imaginary inscribed circle C2 has the smallest diameter among the virtual inscribed circles in contact with each of the multiple blades 52. The chord line L3 is a straight line connecting the inner peripheral portion and the outer peripheral portion of the blade 52 at the position of the innermost peripheral portion 526 in the fan axis center direction DRa.

Further, as shown in FIG. 9B, the one side edge portion 527 is a contact point between the virtual inscribed circle C1 contacting each of the multiple blades 52 at the position of the one side end portion in the fan axis center direction DRa on the inner side of the fan radial direction DRr, and the blade 52. In other words, the one side edge portion 527 is an intersection of the virtual inscribed circle C1 at that position in the fan axis center direction DRa and a chord line L4 at that position.

Figure 15:
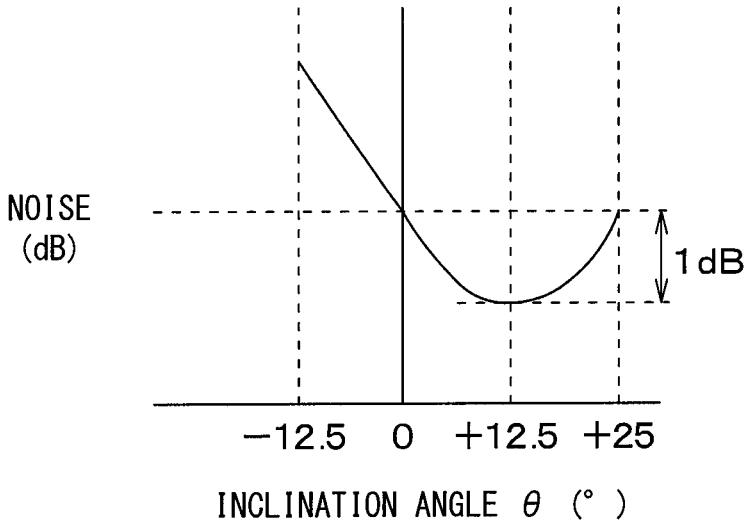
FIG. 15 is a diagram showing a relationship between an inclination angle of a leading edge side portion and a magnitude of noise in the blower according to the first embodiment.

As can be seen from FIG. 15, when the inclination angle θ is larger than 0° and smaller than 25°, the noise can be reduced as compared with a case where the angle θ is 0°.

In the present embodiment, the multiple blades 52 and a rotor housing portion 56 are integrally molded to form an integrally molded product 50. Aside from the multiple blades 52, the integrally molded product 50 does not have a structural portion inside the fan radial direction DRr from the rotor housing portion 56. Only the leading edge side portion 523 of the blade 52 on the inner side of the rotor housing portion 56 in the fan radial direction DRr is inclined to the front side in the rotation direction DRf.

According to the above configuration, when the multiple blades 52 and the rotor housing portion 56 are integrally molded using a pair of molding dies, the fan axial direction DRa can be set as the die cutting direction. For that reason, even if the blade 52 has the inclined shape as described above, that is, a three-dimensional shape, the turbo fan 18 can be easily molded.

In the present embodiment, the multiple blades 52, the shroud ring 54, and the rotor housing portion 56 are integrally molded to form the integrally molded product 50. The overall rotor housing portion 56 is disposed inside the ring inner peripheral end portion 541 of the shroud ring 54 in the fan radial direction DRr.

According to the above configuration, when the multiple blades 52, the shroud ring 54, and the rotor housing portion 56 are integrally molded by using a pair of molding dies, the fan axial direction DRa can be set as the die cutting direction. For that reason, the turbo fan 18 having the multiple blades 52, the shroud ring 54, and the rotor housing portion 56 can be easily molded.

In the present embodiment, the rotor housing portion 56 has multiple ribs 562. The rotor housing portion 56 is fixed to the motor rotor 161 with the multiple ribs 562 in contact with the motor rotor 161. As shown in FIG. 4, each of the multiple ribs 562 is positioned between two adjacent blades 52 in the circumferential direction of the rotor housing portion 56.

In this example, unlike the present embodiment, a case may be considered in which one rib 562 is disposed at a position on the other side of the blade 52 in the fan axis center direction DRa with a space from the blade 52. In that case, when the blade 52 is molded, a part of the molding die is disposed between the blade 52 and the rib 562. This makes it impossible to move the molding die in the fan axis center direction DRa when the molding die is removed from the molded product. Therefore, when an area in which the blade 52 has the inclined shape is the entire area of the leading edge side portion 523, the multiple blades 52 and the rotor housing portion 56 cannot be integrally molded with each other by using the fan axis center direction DRa as the die cutting direction.

In contrast, according to the present embodiment, the rib 562 does not exist on the other side of the blade 52 in the fan axis center direction DRa. For that reason, even if the area in which the blade 52 has the inclined shape is the entire area of the leading edge side portion 523, the multiple blades 52 and the rotor housing portion 56 can be integrally molded by using the fan axis center direction DRa as the die cutting direction.

Figure 16:
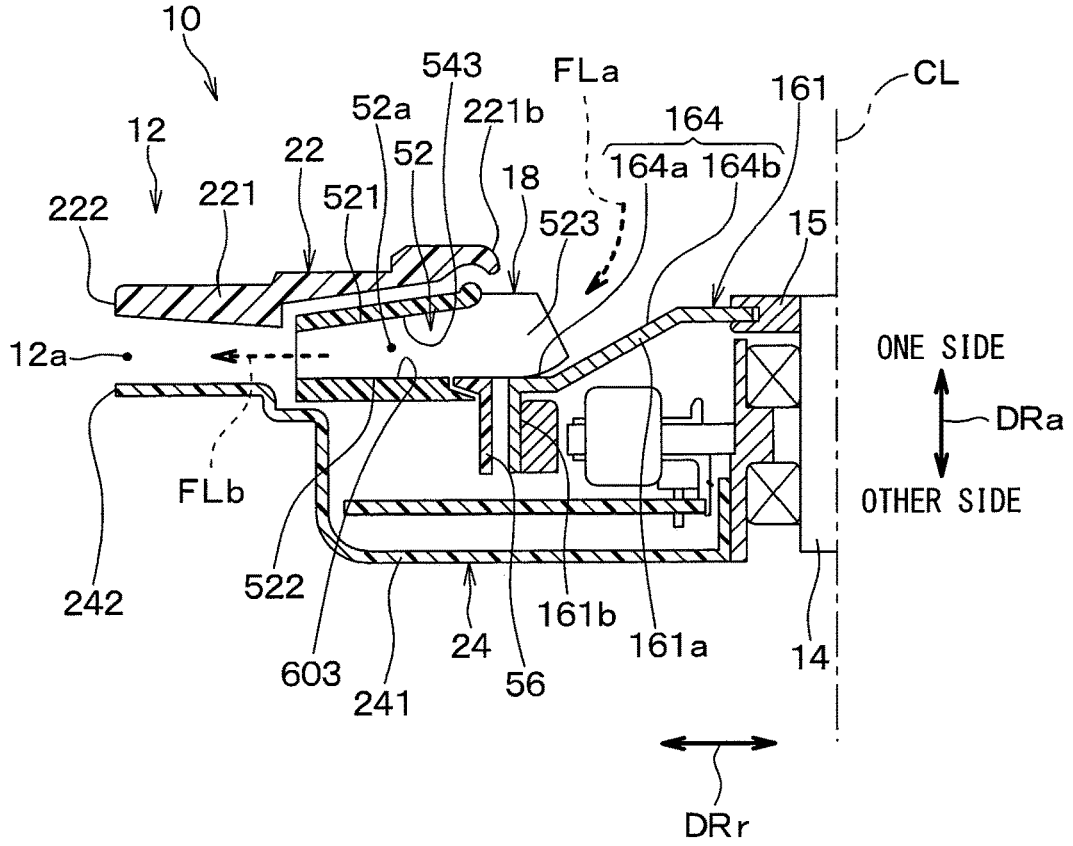
FIG. 16 is a cross-sectional view of the blower of the first embodiment corresponding to a left half of FIG. 3.

In the present embodiment, as shown in FIG. 16, the air flow guide surface 164 of the rotor main body portion 161*a* has a rotor flat portion 164*a* and a rotor inclined portion 164*b*. Hereinafter, the air flow guide surface 164 is referred to as a rotor guide surface 164. The rotor guide surface 164 guides the air flow toward the inter-blade flow channels 52*a* provided between the adjacent blades 52 of the multiple vanes 52.

The rotor flat portion 164*a* is a planar portion of the rotor guide surface 164 which is perpendicular to the fan axis center direction DRa. The rotor inclined portion 164*b* is located on the inner side of the rotor flat portion 164*a* in the fan radial direction DRr. The rotor inclined portion 164*b* is a surface shaped portion of the rotor guide surface 164 which is inclined toward the other side in the fan axis center direction DRa from the inside toward the outside in the fan radial direction DRr.

The air flow FLa drawn from the air intake port 221*a* is directed along the rotor inclined portion 164*b* so that a direction of the air flow can be favorably changed from the fan axis center direction DRa to the fan radial direction. In other words, the intake flow of the leading edge side portion 523 of each of the multiple blades 52 can be improved. Therefore, as compared with the case in which the rotor guide surface 164 does not have the rotor inclined portion 164*b*, noise can be reduced.

In the present embodiment, as shown in FIGS. 6 and 7, a part 531 of the leading edge side portion 523 on the other end portion in the fan axis center direction DRa is in contact with a part 161*c* of the rotor flat portion 164*a*. In other words, the leading edge side portion 523 has a blade contact portion 531 in contact with the rotor flat portion 164*a* at the end portion in the other end side in the fan axis center direction DRa. The motor rotor 161 has a rotor contact portion 161*c* in contact with the leading edge side portion 523 at a portion facing the leading edge side portion 523 in the fan axis center direction DRa. The rotor contact portion 161*c* and the blade contact portion 531 are in contact with each other.

In this state, an outer end portion 164*c* of the rotor guide surface 164 in the fan radial direction DRr is located at the same position in the fan axis center direction DRa as an end portion 564 on one side of the fan axis center direction DRa of the side plate guide surface 603 and the rotor housing portion 56. One end portion 564 of the rotor housing portion 56 in the fan axis center direction DRa corresponds to a cylinder end portion of a cylinder portion on one end in the axial direction.

Figure 17:
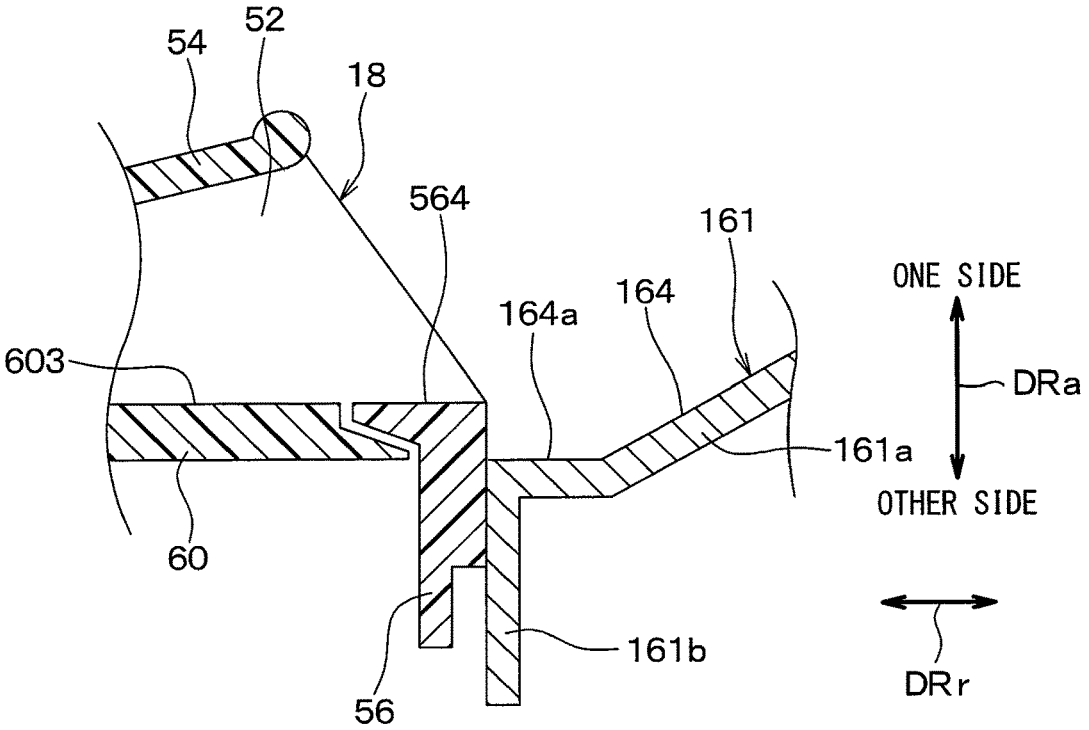
FIG. 17 is an enlarged cross-sectional view of a periphery of a rotor housing portion of a blower in Comparative Example 2.

Now, the present embodiment will be compared with Comparative Example 2 shown in FIG. 17. Comparative Example 2 differs from the present embodiment in that each of the multiple blades 52 does not protrude inward of the rotor housing portion 56 in the fan radial direction DRr. For that reason, the motor rotor 161 is not in contact with each of the multiple blades 52.

Comparative Example 2 suffers from the same problem as that of a centrifugal blower of Patent Literature 2. At the time of manufacturing the centrifugal blower, the turbo fan 18 and the motor rotor 161 are assembled together. In the assembly, the motor rotor 161 is disposed inside the rotor housing portion 56. At that time, there is no member for positioning the turbo fan 18 and the motor rotor 161 in the fan axis center direction DRa. For that reason, as shown in FIG. 17, a positional deviation occurs between the turbo fan 18 and the motor rotor 161 in the fan axis center direction DRa, and a position of the rotor guide surface 164 may be located on the other side of the rotor housing portion 56 in the fan axis center direction DRa with respect to the end portion 564 of the rotor housing portion 56 on one side. In that case, the air flow guided by the rotor guide surface 164 collides with a side surface of the rotor housing portion 56. The noise is deteriorated by inhibiting the air flow in this manner.

On the contrary, according to the present embodiment, at the time of assembling the turbo fan 18 and the motor rotor 161, the motor rotor 161 is inserted into the rotor housing portion 56. At that time, the rotor contact portion 161*c* and the blade contact portion 531 are brought into contact with each other. In other words, the assembling of the turbo fan 18 and the motor rotor 161 is completed in a state in which both of the rotor contact portion 161*c* and the blade contact portion 531 are in contact with each other. As a result, the positions of the turbo fan 18 and the motor rotor 161 in the fan axis center direction DRa are determined. The outer end portion 164*c* of the rotor guide surface 164 is located at the same position in the fan axis center direction DRa as the end portion 564 on one side of the side plate guide surface 603 and the rotor housing portion 56. For that reason, the air flow guided by the air flow guide surface 164 can be prevented from colliding with the side surface of the rotor housing portion 56.

According to the above configuration, the motor rotor 161 guides the air flow toward the inter-blade flow channels 52*a*. For that reason, a thickness of the blower 10 can be reduced as compared with the case in which the blower includes the member for guiding the air flow toward the inter-blade flow channels 52*a* on one side of the motor rotor 161 in the fan axis center direction DRa.

Therefore, according to the present embodiment, the thickness of the blower 10 can be reduced while avoiding the obstruction of the air flow.

In the present embodiment, all of the side plate guide surfaces 603 are located at the same position in the fan axis center direction DRa as the end portion 564 of the rotor housing portion 56 on one side, however, not limited to the above configuration. The inner peripheral end portion of the side plate guide surface 603 on the inner side in the fan radial direction DRa may be located at the same position in the fan axis center direction DRa as the end portion 564 of the rotor housing portion 56 at one side.

Second Embodiment

Figure 18:
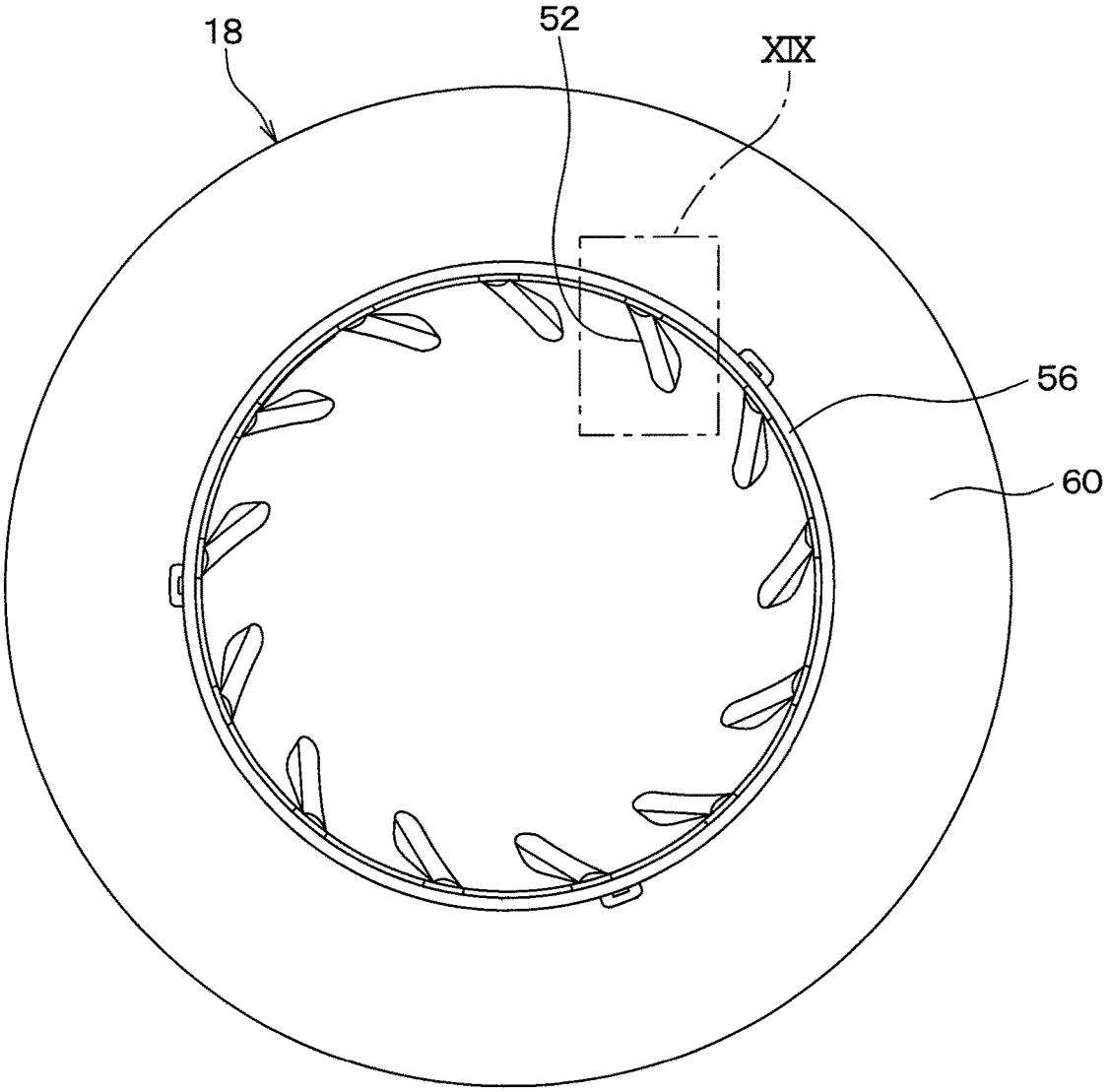
FIG. 18 is a bottom view of a turbo fan according to a second embodiment.
Figure 19:
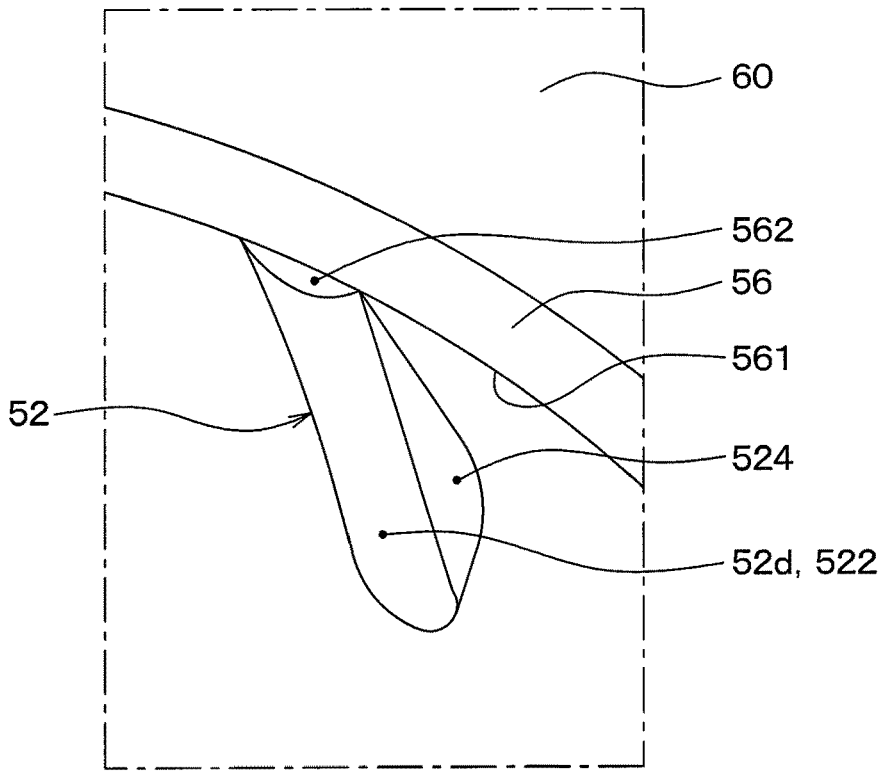
FIG. 19 is an enlarged view of an XIX portion in FIG. 18.

As shown in FIGS. 18 and 19, in the present embodiment, a placement location of multiple ribs 562 is changed from that in the first embodiment. The other configuration of the blower 10 is the same as that of the first embodiment. FIG. 18 is a diagram of a turbo fan 18 as viewed from the other side in a fan axis center direction DRa in parallel to the fan axis center direction DRa according to the present embodiment. FIG. 19 is an enlarged view of one blade 52 in FIG. 18.

As shown in FIG. 19, each of the multiple ribs 562 is located on a lower surface 52*d* of the blade 52. The lower surface 52*d* of the blade 52 is the other side blade end portion 522 shown in FIG. 3.

Figure 20:
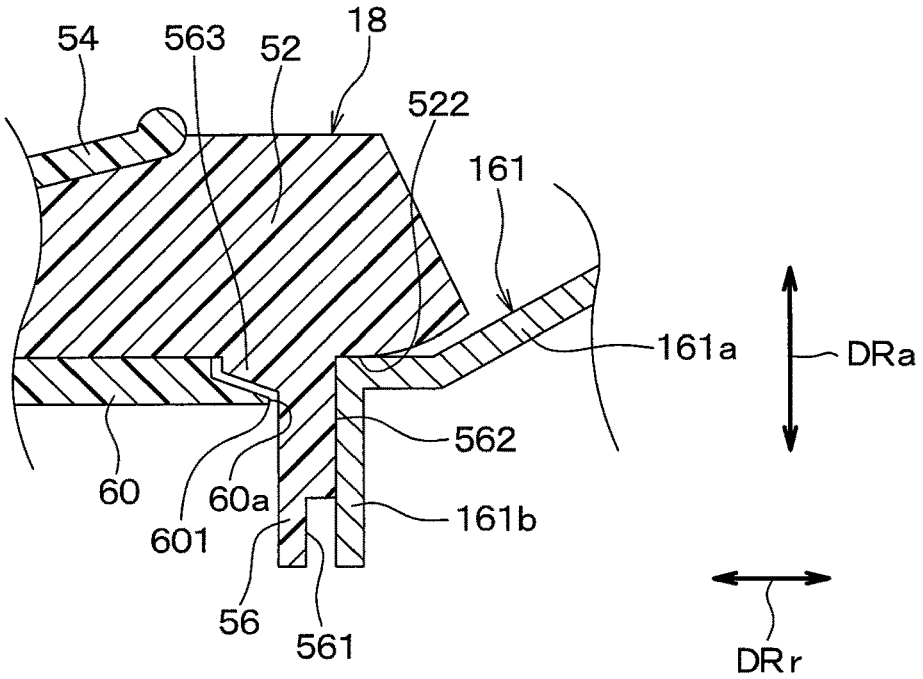
FIG. 20 is a cross-sectional view of a main part of a turbo fan according to the second embodiment.

More specifically, one rib 562 is connected to the other side blade end portion 522 as shown in FIG. 20. One rib 562 extends from the other side blade end portion 522 to the other side in the fan axis center direction DRa. As shown in FIG. 19, one rib 562 entirely overlaps with one blade 52 in the fan axis center direction DRa.

As described in the first embodiment, if there is a space between the blade 52 and each of the ribs 562 in the fan axis center direction DRa, the molding die cannot be moved in the fan axis center direction DRa at the time of die cutting.

On the contrary, according to the present embodiment, there is no space between the blade 52 and the rib 562 in the fan axis center direction DRa. For that reason, even if the area in which the blade 52 has the inclined shape is the entire area of the leading edge side portion 523, the multiple blades 52 and the rotor housing portion 56 can be integrally molded by using the fan axis center direction DRa as the die cutting direction.

Third Embodiment

Figure 21:
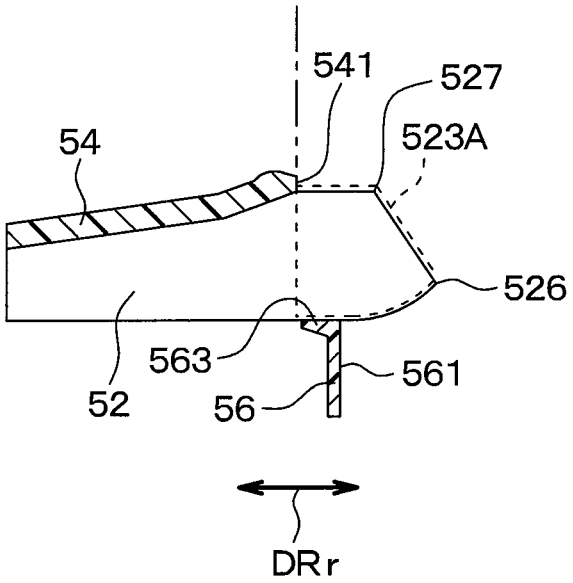
FIG. 21 is a cross-sectional view of a main part of a turbo fan according to a third embodiment.

In each of the above embodiments, the area in which the blades 52 are inclined is set as the leading edge side portion 523, however, are not limited to such a configuration. An area in which the blades 52 are inclined may be an area from an innermost peripheral portion 526 of the blades 52 to a predetermined position outside the innermost peripheral portion 526 of the blades 52 in the fan radial direction DRr. As long as the blades 52 can be formed by molding using a molding die, as shown in FIG. 21, the area in which the blades 52 are inclined may be an area 523A from the position of the innermost peripheral portion 526 of the blades 52 in the fan radial direction DRr to a predetermined position outside the rotor housing portion 56 in the fan radial direction DRr. In that case, the die cutting direction at the time of forming the blade 52 is a direction other than the fan axis center direction DRa.

Fourth Embodiment

Figure 22:
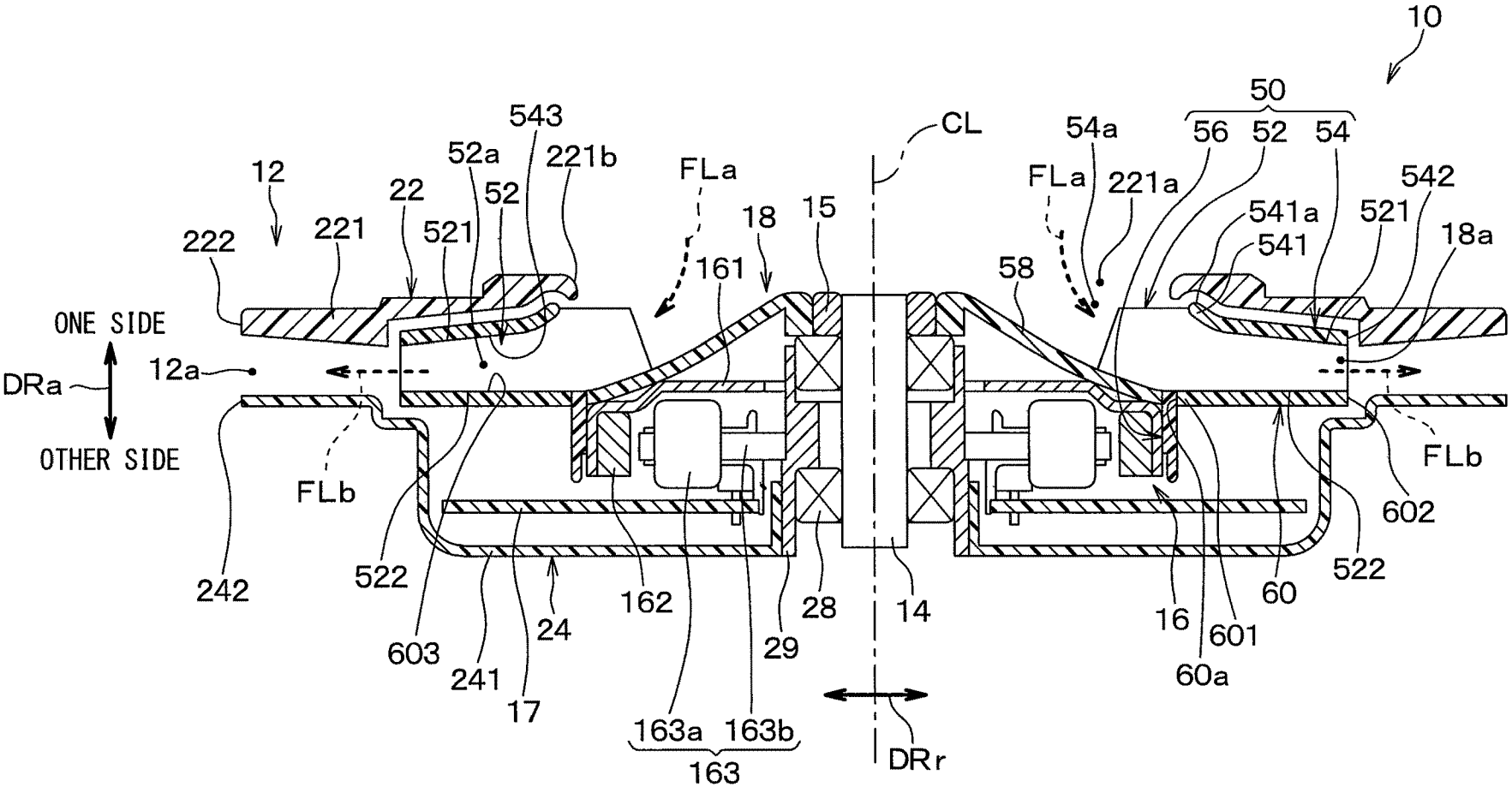
FIG. 22 is a cross-sectional view of a blower according to a fourth embodiment.

In each of the above embodiments, the motor rotor 161 is used as a fixing member for fixing the rotation shaft 14 and the turbo fan 18 together, however, is not limited to the above configuration. As shown in FIG. 22, a fan boss portion 58 may be used as the fixing member.

A blower 10 shown in FIG. 22 is different from that in the first embodiment in that the fan boss portion 58 is provided. The other configuration of the blower 10 is the same as that of the first embodiment. The fan boss portion 58 is a resin molded product molded separately from a fan main body member 50. The fan boss portion 58 is joined to the other side blade end portion 522 and a rotor housing portion 56. In the present embodiment, instead of the surface 164 of the rotor main body portion 161*a* according to the first embodiment, a surface of the fan boss portion 58 on one side in the fan axis center direction DRa configures an air flow guide surface for guiding an air flow.

Fifth Embodiment

The present embodiment is different from the first embodiment in the shape of the blade contact portion. The other configuration of the blower 10 is the same as that of the first embodiment.

Figure 23:
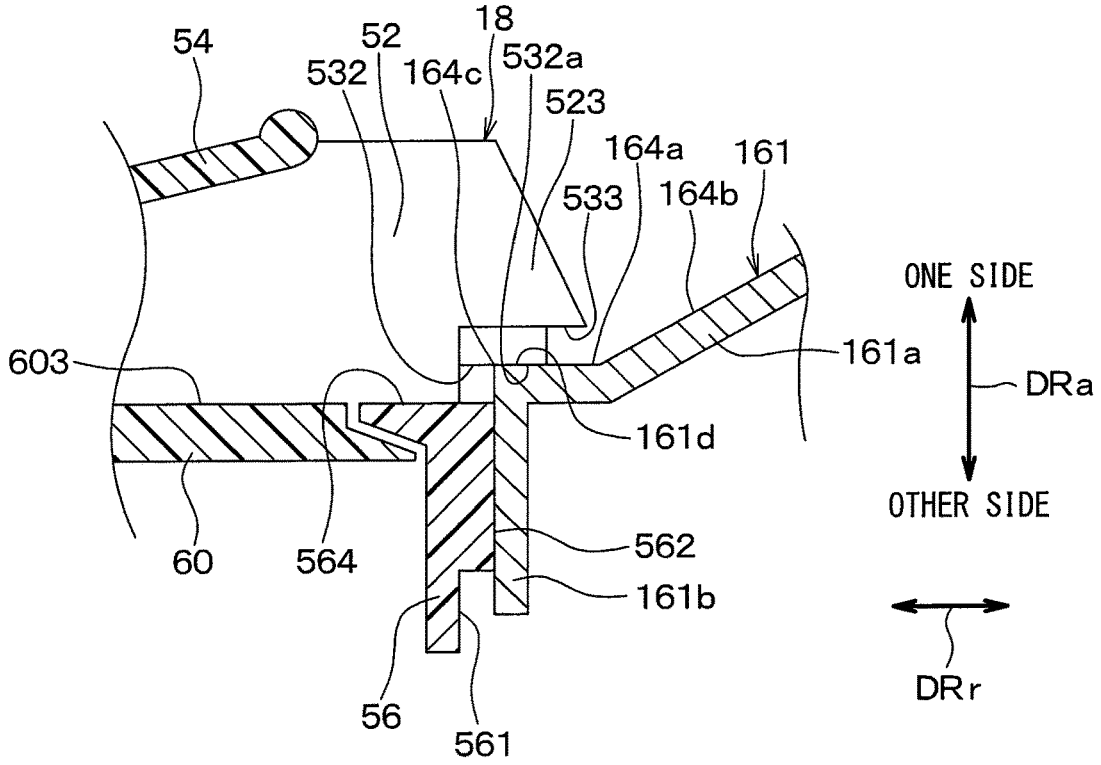
FIG. 23 is an enlarged cross-sectional view of a periphery of a rotor housing portion of a blower according to a fifth embodiment.
Figure 24:
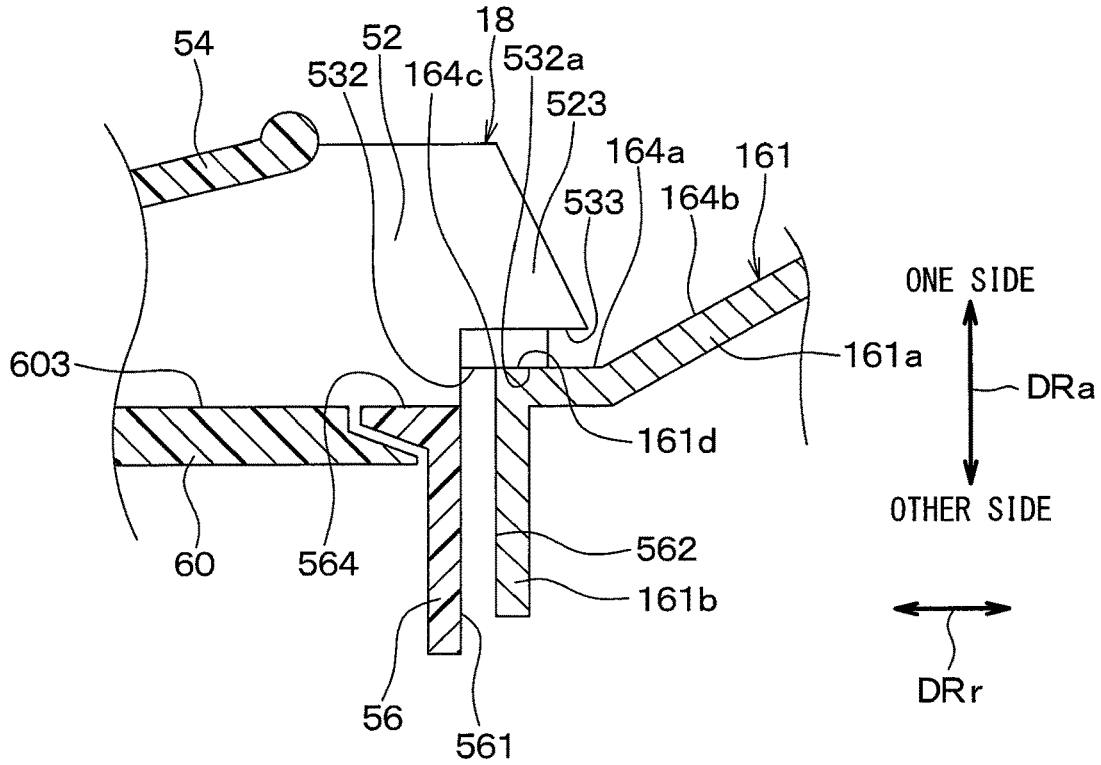
FIG. 24 is an enlarged cross-sectional view of the periphery of the rotor housing portion of the blower, at a position different from that of FIG. 23 according to the fifth embodiment.

As shown in FIGS. 23 and 24, a leading edge side portion 523 has a blade flat portion 532 at the end portion in the other end side in a fan axis center direction DRa. The blade flat portion 532 faces a rotor flat portion 164*a* of a motor rotor 161 in a fan axis center direction DRa. The blade flat portion 532 has a planar shape perpendicular to the fan axis center direction Dra. The blade flat portion 532 is parallel to the rotor flat portion 164*a*. A part 532*a* of the blade flat portion 532 is in contact with a portion 161*d* of the rotor flat portion 164*a*. Therefore, in the present embodiment, a part 532*a* of the blade flat portion 532 configures a blade contact portion. A part 161*d* of the rotor flat portion 164*a* configures a rotor contact portion.

In this state, an outer end portion 164*c* of the rotor guide surface 164 is located on one side of the fan axis center direction DRa with respect to an end portion 564 of the side plate guide surface 603 and the rotor housing portion 56 on one side. For that reason, also in the present embodiment, similarly to the first embodiment, when the turbo fan 18 and the motor rotor 161 are assembled together, the part 532*a* of the blade flat portion 532 and the part 161*d* of the rotor flat portion 164*a* are brought into contact with each other. In this state, the assembly of the turbo fan 18 and the motor rotor 161 is completed. As a result, the positions of the turbo fan 18 and the motor rotor 161 in the fan axis center direction DRa are determined. Therefore, the air flow guided by the air flow guide surface 164 can be prevented from colliding with the side surface of the rotor housing portion 56.

In the present embodiment, the leading edge side portion 523 has an inner flat portion 533 on the other side in the fan axis center direction DRa and on the inner side of the blade flat portion 532 in the fan radial direction DRr. The inner flat portion 533 is a plane perpendicular to the fan axis center direction Dra. The blade flat portion 532 is located on the other side of the inner flat portion 533 in the fan axis center direction DRa. For that reason, a step is formed by the blade flat portion 532 and the inner flat portion 533.

The blade flat portion 532 and the rotor flat portion 164*a* may not be perpendicular to the fan axis center direction Dra. The blade flat portion 532 and the rotor flat portion 164*a* may be parallel to each other so as to be in surface contact with each other.

Unlike the present embodiment, when the blade flat portion 532 and the rotor flat portion 164*a* are not provided, the positions of the blade contact portion and the rotor contact portion may be deviated in the fan axis center direction DRa.

On the contrary, according to the present embodiment, the position of the blade flat portion 532 coincides with the position of the blade contact portion. The position of the rotor flat portion 164*a* coincides with the position of the rotor flat portion. For that reason, the positions of the blade contact portion and the rotor contact portion are not deviated from each other in the fan axis center direction DRa. Therefore, a positioning accuracy of the motor rotor 161 and the rotor housing portion 56 can be improved as compared with the case where the blade flat portion 532 and the rotor flat portion 164*a* are not provided. Therefore, the positioning accuracy of the turbo fan 18 and the motor rotor 161 can be improved.

Further, in the present embodiment, the leading edge side portion 523 is located outside the rotor inclined portion 164*b* in the fan radial direction DRr. As a result, the leading edge side portion 523 can be prevented from coming into contact with the rotor inclined portion 164*b*.

In the present embodiment, a part 532*a* of the blade flat portion 532 configures the blade contact portion. However, all of the blade flat portions 532 may configure the blade contact portion.

In the present embodiment, a part 161*d* of the rotor flat portion 164*a* configures the rotor contact portion. However, all of the rotor flat portions 164*a* may configure the rotor contact portion.

Sixth Embodiment

Figure 25:
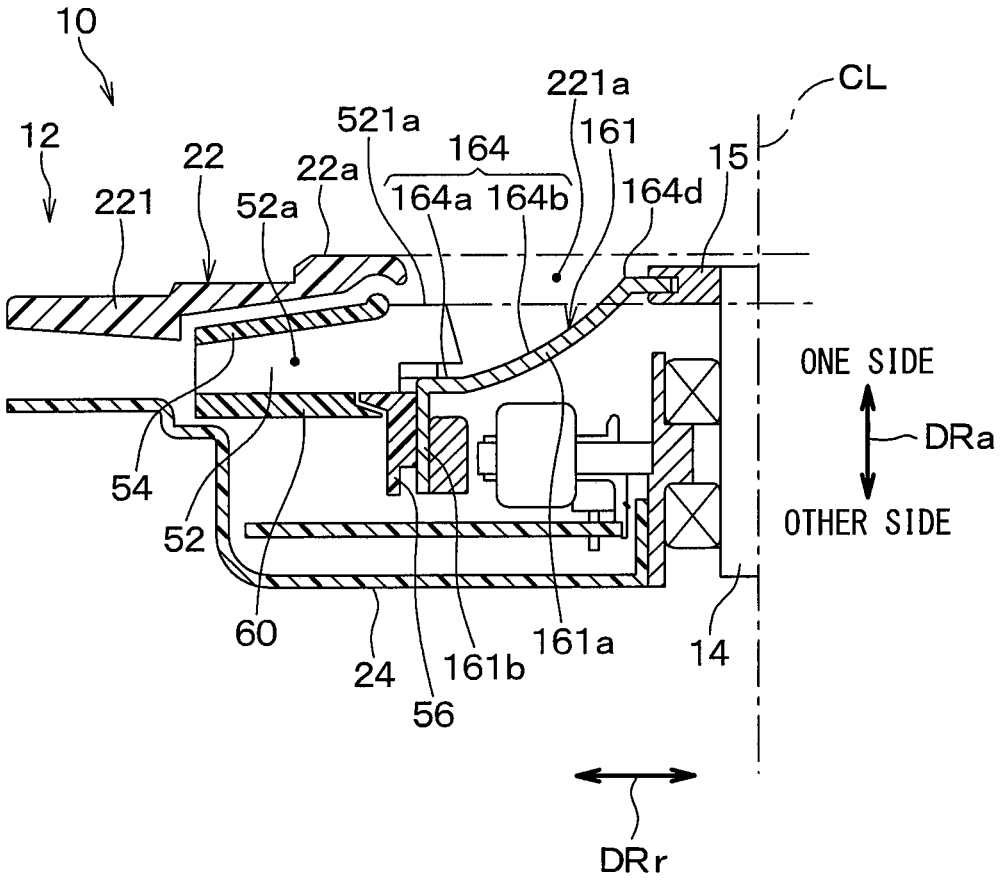
FIG. 25 is a cross-sectional view of a blower according to a sixth embodiment.

As shown in FIG. 25, in the present embodiment, the placement of the motor rotor 161 is changed as compared with the fifth embodiment. The other configuration of the blower 10 is the same as that of the first embodiment.

In the present embodiment, a one side end portion 164*d* of the rotor guide surface 164 is located on one side of a one side end portion 521*a* of each of the multiple blades 52 in the fan axis center direction DRa. A one side end portion 164*d* of the rotor guide surface 164 is located on the other side of a one side end portion 22*a* of the first case member 22 in the fan axis center direction DRa.

The one side end portion 164*d* of the rotor guide surface 164 is an end located on one side of the rotor guide surface 164 in the fan axis center direction DRa. The one side end portion 521*a* of each of the multiple blades 52 is an end portion 521*a* located on the most one side of each of the multiple blades 52 in the fan axis center direction DRa. The one side end portion 22*a* of the first case member 22 is an end of the casing 12 on one side in the fan axis center direction DRa. The one side end portion 22*a* of the first case member 22 is an end of the first case member 22 on one side of the peripheral portion of the air intake port 221*a* in the fan axis center direction DRa. The air intake port 221*a* is an inlet for drawing the air into the interior of the casing 12.

In this manner, the one side end portion 164*d* of the rotor guide surface 164 is positioned on one side of each of the multiple blades 52 in the fan axis center direction DRa, and is positioned on the other side of the one side end portion 22*a* of the first case member 22 in the fan axis center direction DRa.

According to the above configuration, unlike the present embodiment, the direction of the air flow can be changed from the fan axis center direction DRa to the fan radial direction more favorably from the upstream side, as compared with the case where the one side end portion 164*d* of the rotor guide surface 164 is positioned on the other side of the one side end portion 521*a* of each of the multiple blades 52 in the fan axis center direction DRa. In other words, the intake flow can be improved. Therefore, noise can be further reduced.

Other Embodiments (1) In each of the embodiments described above, the rotor housing portion 56 has the multiple ribs 562, however, is not limited to such a configuration. The rotor housing portion 56 may not have the multiple ribs 562. In that case, the rotor outer peripheral portion 161*b* is fixed to the inner peripheral side of the rotor housing portion 56 in a state where the inner peripheral surface 561*a* of the rotor housing portion 56 is in contact with the rotor outer peripheral portion 161*b*. Also in that case, similarly to the first embodiment, it is preferable that the area in which the blades 52 are inclined is an area from the position of the innermost peripheral portion 526 of the blades 52 in the fan radial direction DRr to the position of the inner peripheral surface 561*a* of the rotor housing portion 56, that is, the leading edge side portion 523.

(2) It should be appreciated that the present disclosure is not limited to the embodiments described above and can be modified appropriately within the scope of the appended claims. The embodiments above are not irrelevant to one another and can be combined appropriately unless a combination is obviously impossible. In the respective embodiments above, it goes without saying that elements forming the embodiments are not necessarily essential unless specified as being essential or deemed as being apparently essential in principle. In a case where a reference is made to the components of the respective embodiments as to numerical values, such as the number, values, amounts, and ranges, the components are not limited to the numerical values unless specified as being essential or deemed as being apparently essential in principle. Also, in a case where a reference is made to the components of the respective embodiments above as to shapes and positional relations, the components are not limited to the shapes and the positional relations unless explicitly specified or limited to particular shapes and positional relations in principle.

CONCLUSION

According to a first aspect represented by a part or all of the embodiments, a centrifugal blower includes a rotation shaft, and a turbo fan. The turbo fan includes a plurality of blades, a shroud ring, and an other end plate. Each of the plurality of blades has a blade surface located on a front side of the blade in a rotation direction of the turbo fan. Each of the plurality of blades is inclined in an area from an innermost peripheral portion of each of the plurality of blades at a radially innermost side of the turbo fan to a predetermined position of the blade outside the radially innermost peripheral portion. Specifically, the blade is inclined such that at least a part of one side portion located on the one side in the rotation axis direction is located on a front side of an other side portion located on the other side of the one side portion in the rotation axis direction with respect to the blade surface in the rotation axis direction.

According to a second aspect, the centrifugal blower further includes a fixing member that fixes the rotation shaft and the turbo fan. The turbo fan includes a cylinder portion that extends from the other side blade end portion of each of the plurality of blades to the other side in the rotation axis direction. The cylinder portion is located outside the radially innermost peripheral portion of each of the plurality of blades and fixed to the fixing member located on the inner peripheral side of the cylinder portion. The plurality of blades and the cylinder portion are configured as an integrally molded product. The predetermined position is located inside the cylinder portion in the radial direction.

According to the above configuration, when the multiple blades and the rotor housing portion are integrally molded using the molding die, the fan axial direction can be set as the die cutting direction. For that reason, even if the blade has the inclined shape as described above, the turbo fan can be easily molded.

According to a third aspect, the shroud ring is configured as the integrally molded product together with the plurality of blades and the cylinder portion. The overall cylinder portion is disposed radially inside the ring inner peripheral end portion inside the shroud ring in the radial direction.

According to the above configuration, when the multiple blades, the shroud ring, and the cylinder portion are integrally molded using the molding die, the fan axial direction can be set as the die cutting direction. For that reason, the turbo fan having the multiple blades, the shroud ring, and the cylinder portion can be easily molded.

According to a fourth aspect, the cylinder portion includes a main body that has a cylindrical shape and has an inner peripheral surface, and a plurality of protrusion portions that project from the inner peripheral surface and aligned in a circumferential direction of the main body portion. The cylinder portion is fixed to the fixing member in a state in which the plurality of protrusion portions are in contact with the fixing member. The predetermined position is inside the inner peripheral surface in the radial direction.

Thus, the cylinder portion with the plural protrusion portions can be adopted. The predetermined position, in this case, is preferably on the inner side of the inner peripheral surface of the cylinder portion in the radial direction.

According to a fifth aspect, each of the plurality of protrusion portions is located between two adjacent blades in the circumferential direction of the cylinder portion. For that reason, even if the blade has the inclined shape entirely on the inner side of the inner peripheral surface of the main body of the cylinder portion in the radial direction, the multiple blades and the cylinder portion can be integrally molded by using the fan axis center direction as the die cutting direction.

According to a sixth aspect, each of the plurality of protrusion portions is connected to the other side blade end portion, and the overall of one protrusion portion of the plurality of protrusion portions overlaps with one of the plurality of blades in the rotation axis direction. For that reason, even if the blade has the inclined shape in the entire area on the inner side of the inner peripheral surface of the main body of the cylinder portion in the radial direction, the multiple blades and the cylinder portion can be integrally molded by using the fan axis center direction as the die cutting direction.

According to a seventh aspect, the innermost peripheral portion is defined as a base point. A one side edge portion located radially inside the one side blade end portion is defined as a first point. An intersection of a chord line obtained by projecting a chord line of the blade at the position of the innermost peripheral portion in parallel with the rotation axis direction on a plane passing through the first point and perpendicular to the rotation axis direction, and a virtual inscribed circle which passes through the first point and is in contact with the inner side of each of the plurality of blades in the radial direction is defined as a second point. At this time, on a plane passing through three points including the base point, the first point, and the second point, an angle formed between a straight line connecting the based point and the first point and a straight line connecting the base point and the second point is larger than 0° and smaller than 25°.

It is preferable that the inclination angle of the blade is within this range. Thereby, the noise can be reduced compared with a case where the angle is 0°.

According to an eighth aspect, a centrifugal blower includes a rotation shaft, an outer rotor, and a turbo fan. The turbo fan includes a plurality of blades, a shroud ring, an other end plate, and a cylinder portion. The cylinder portion is located inside the other end plate in the radial direction of the turbo fan and fixed to the outer rotor disposed on the inner peripheral side of the cylinder portion. A surface of the outer rotor on one side in the axial direction configures a rotor guide surface that guides an air flow toward an inter-blade flow channel provided between adjacent blades among the plurality of blades. Each of the plurality of blades has a leading edge side portion located radially inside the cylinder portion. An outer end portion of the rotor guide surface in the radial direction is located at the same position in the axial direction as the one side cylinder end portion of the cylinder portion in the axial direction, or at a position on the one side of the cylindrical end portion in the axial direction, in a state in which a rotor contact portion of the outer rotor and a blade contact portion of the leading edge side portion are in contact with each other.

According to a ninth aspect, the cylinder portion is located inward of the shroud ring in the radial direction. The multiple blades, the shroud ring, and the cylinder portion are configured as an integrally molded product.

Thereby, since the cylinder portion is located on the inner side of the shroud ring in the radial direction, when the multiple blades, the shroud ring, and the cylinder portion are integrally molded using the molding die, the fan axial direction can be set as the die cutting direction. Further, since the cylinder portion is integrally molded with the blades, the cylinder portion and the rotation shaft can be made in alignment. The runout due to the misalignment between the cylinder portion and the rotation shaft can be reduced.

According to a tenth aspect, the rotor guide surface has a rotor flat portion facing the leading edge side portion in the axial direction on the outer side in the radial direction. The leading edge side portion has a blade flat portion facing the rotor flat portion in the axial direction at the end portion in the other end side in the axial direction. At least a portion of the rotor flat portion configures the rotor contact portion, and at least a part of the blade flat portion configures the blade contact portion.

Therefore, a positioning accuracy of the turbo fan and the outer rotor can be improved as compared with the case where the blade flat portion and the rotor flat portion are not provided. Therefore, the positioning accuracy of the turbo fan and the motor rotor can be improved.

According to an eleventh aspect, the rotor guide surface has a rotor inclined portion radially inside the rotor flat portion. The rotor inclined portion has a surface shape that is inclined from the inner side to the outer side in the radial direction toward the other side in the axial direction.

Thus, the air flow direction can be suitably changed from the axial direction to the radial direction, due to the air flow along the rotor inclined portion. Accordingly, the noise can be reduced compared with a case where the rotor guide surface does not have the rotor inclined portion.

According to a twelfth aspect, the leading edge side portion is located outside the rotor inclined portion in the radial direction. Therefore, the leading edge side portion can be restricted from contacting the rotor inclined portion.

According to a thirteenth aspect, the centrifugal blower further includes a casing that houses the rotation shaft, the outer rotor, and the turbo fan. The casing is provided with an air intake port that draws air on the one side in the axial direction. The one side end of the rotor guide surface in the axial direction is located on the one side of each of the plurality of blades in the axial direction, and is located on the other side of the casing in the axial direction relative to the one side end portion of the peripheral portion of the air intake port in the axial direction.

Therefore, the air flow direction can be changed from the axial direction to the radial direction more favorably from the upstream side, as compared with the case where the one side end portion of the rotor guide surface is positioned on the other side of the one side end portion of each of the multiple blades in the fan axis center direction DRa. Therefore, noise can be further reduced.

According to a fourteenth aspect, the cylinder portion includes a main body portion having a cylindrical shaped and an inner peripheral surface, and a plurality of protrusion portions projecting from the inner peripheral surface and aligned in the circumferential direction of the main body. The cylinder portion is fixed to the outer rotor in a state in which the plurality of protrusion portions are in contact with the fixing member. Thus, the misalignment can be reduced between the turbo fan and the outer rotor compared with a case where the plurality of protrusion portions are not provided.

According to a fifteenth aspect, it is preferable that each of the plurality of protrusion portions is located between adjacent blades of the plurality of blades in the circumferential direction of the cylinder portion.

According to a sixteenth aspect, it is preferable that each of the plurality of protrusion portions is connected to the other side blade end portion, and the overall of one protrusion portion of the plurality of protrusion portions overlaps with one of the plurality of blades in the rotation axis direction.

What is claimed is:

1. A centrifugal blower for blowing air, comprising:

a rotation shaft;

an outer rotor of a motor which is fixed to the rotation shaft; and a turbo fan fixed to the outer rotor, wherein the turbo fan includes:

a plurality of blades disposed around the rotation shaft;

a shroud ring coupled to a one side blade end portion located on one side of each of the plurality of blades in an axial direction of the rotation shaft, the shroud ring having an inlet hole into which air is drawn;

an other end plate that is coupled to an other side blade end portion located on the other side of each of the plurality of blades in the axial direction; and a cylinder portion that extends from the other blade end portion of each of the plurality of blades to the other side in the axial direction, the cylinder portion is located inside the other end plate in the radial direction of the turbo fan and fixed to the outer rotor disposed on an inner peripheral side of the cylinder portion, a surface of the outer rotor on one side in the axial direction configures a rotor guide surface that guides an air flow toward an inter-blade flow channel provided between adjacent blades among the plurality of blades, each of the plurality of blades has a leading edge side portion located radially inside the cylinder portion, and an outer end portion of the rotor guide surface in the radial direction is located at the same position in the axial direction as a cylinder end portion of the cylinder portion located on the one side in the axial direction, in a state in which a rotor contact portion of the outer rotor and a blade contact portion of the leading edge side portion are in contact with each other.

2. The centrifugal blower according to claim 1, wherein the cylinder portion is located inward of the shroud ring in the radial direction, and the multiple blades, the shroud ring, and the cylinder portion are configured as an integrally molded product.

3. The centrifugal blower according to claim 1, wherein the rotor guide surface has a rotor flat portion facing the leading edge side portion in the axial direction on an outer side in the radial direction, the leading edge side portion has a blade flat portion facing the rotor flat portion in the axial direction at the end portion in the other end side in the axial direction, at least a part of the rotor flat portion including the rotor contact portion, and at least a part of the blade flat portion including the blade contact portion.

4. The centrifugal blower according to claim 3, wherein the rotor guide surface has a rotor inclined portion radially inside the rotor flat portion, and the rotor inclined portion has a surface shape that is inclined from an inner side to the outer side in the radial direction toward the other side in the axial direction.

5. The centrifugal blower of claim 4, wherein the leading edge side portion is located outside the rotor inclined portion in the radial direction.

6. The centrifugal blower according to claim 5, further comprising a casing that houses the rotation shaft, the outer rotor, and the turbo fan, wherein the casing has an air intake port that draws air on the one side in the axial direction, and the one side end of the rotor guide surface in the axial direction is located on the one side of each of the plurality of blades in the axial direction, and is located on the other side of the casing in the axial direction relative to the one side end portion of the peripheral portion of the air intake port in the axial direction.

7. The centrifugal blower according to claim 1, wherein the cylinder portion includes a main body portion having a cylindrical shape and an inner peripheral surface, and a plurality of protrusion portions projecting from the inner peripheral surface and aligned in the circumferential direction of the main body portion, and the cylinder portion is fixed to the outer rotor in a state in which the plurality of protrusion portions are in contact with a fixing member.

8. The centrifugal blower according to claim 7, wherein each of the plurality of protrusion portions is located between adjacent blades of the plurality of blades in the circumferential direction of the cylinder portion.

9. The centrifugal blower according to claim 7, wherein each of the plurality of protrusion portions is connected to the other side blade end portion, and the overall of one protrusion portion of the plurality of protrusion portions overlaps with one of the plurality of blades in the rotation axis direction.

10. The centrifugal blower according to claim 1, wherein an outermost end of the rotor guide surface in the radial direction is located at the same position in the axial direction as an outermost end of the cylinder end portion located on the one side in the axial direction, in a state in which the rotor contact portion of the outer rotor and the blade contact portion of the leading edge side portion are in contact with each other.

11. The centrifugal blower according to claim 1, wherein an outermost end of the rotor guide surface in the radial direction is located at a position on the one side of an outermost end of the cylinder end portion in the axial direction, in a state in which the rotor contact portion of the outer rotor and the blade contact portion of the leading edge side portion are in contact with each other.

* * * * *